US010577216B2

(12) United States Patent
Kobayashi

(10) Patent No.: US 10,577,216 B2
(45) Date of Patent: Mar. 3, 2020

(54) APPARATUS FOR PROCESSING SHEETS AND APPARATUS FOR FORMING IMAGES PROVIDED WITH THE APPARATUS

(71) Applicant: Misao Kobayashi, Kofu (JP)

(72) Inventor: Misao Kobayashi, Kofu (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 89 days.

(21) Appl. No.: 15/620,285

(22) Filed: Jun. 12, 2017

(65) Prior Publication Data

US 2017/0362047 A1 Dec. 21, 2017

(30) Foreign Application Priority Data

Jun. 15, 2016 (JP) ..... 2016-118491
Jun. 15, 2016 (JP) ..... 2016-118493

(51) Int. Cl.

| | |
|---|---|
| ***B65H 37/04*** | (2006.01) |
| ***B31F 5/02*** | (2006.01) |
| ***B42B 2/02*** | (2006.01) |
| ***B42B 5/00*** | (2006.01) |

(Continued)

(52) U.S. Cl.

CPC ..... *B65H 37/04* (2013.01); *B31F 5/02* (2013.01); *B42B 2/02* (2013.01); *B42B 5/00* (2013.01); *B65H 31/02* (2013.01); *G03G 15/6544* (2013.01); *B65H 2301/1635* (2013.01); *B65H 2301/4212* (2013.01); *B65H 2301/4213* (2013.01); *B65H 2301/51611* (2013.01); *B65H 2301/51616* (2013.01); *B65H 2405/11151* (2013.01); *B65H 2801/27* (2013.01); *G03G 2215/00852* (2013.01)

(58) Field of Classification Search

CPC ..... B65H 2301/51616

See application file for complete search history.

(56) References Cited

U.S. PATENT DOCUMENTS

| | | | | |
|---|---|---|---|---|
| 7,654,511 | B2 | 2/2010 | Nagata et al. | |
| 8,246,033 | B2 * | 8/2012 | Sato | B42C 1/12 270/58.07 |
| 8,297,610 | B2 | 10/2012 | Shiraishi | |

(Continued)

FOREIGN PATENT DOCUMENTS

| | | |
|---|---|---|
| JP | 2006-248685 A | 9/2006 |
| JP | 2012-027118 A | 2/2012 |

(Continued)

*Primary Examiner* — Jennifer E Simmons

(74) *Attorney, Agent, or Firm* — Manabu Kanesaka

(57) ABSTRACT

The present apparatus is provided with a placement tray (processing tray) to place sheets to undergo binding processing, and a bind unit that is able to shift along an end edge of sheets on the placement tray and that binds a plurality of sheets as a single bunch, where in the bind unit, a needle bind unit for performing binding processing on a bunch of sheets with a needle and a needleless bind unit for performing binding processing without a needle are provided together in a shift direction of the bind unit, and a length of the needleless bind unit is configured to be shorter than a length of the needle bind unit in the shift direction of the bind unit. By this means, provided is the apparatus capable of miniaturizing the entire apparatus, with the needle bind unit and needleless bind unit provided together.

18 Claims, 25 Drawing Sheets

(51) Int. Cl.
*G03G 15/00* (2006.01)
*B65H 31/02* (2006.01)

(56) References Cited

U.S. PATENT DOCUMENTS

| | | | | |
|---|---|---|---|---|
| 9,283,797 | B2 | 3/2016 | Tanaka et al. | |
| 2012/0018943 | A1* | 1/2012 | Shiraishi | B65H 37/04 270/58.08 |
| 2015/0037119 | A1* | 2/2015 | Tanaka | B42B 5/00 412/33 |
| 2015/0183255 | A1* | 7/2015 | Nakagomi | B65H 43/02 412/11 |
| 2015/0353316 | A1 | 12/2015 | Abe | |

FOREIGN PATENT DOCUMENTS

| | | | |
|---|---|---|---|
| JP | 2015-030584 | A | 2/2015 |
| JP | 2016-010968 | A | 1/2016 |

* cited by examiner

APPARATUS FOR PROCESSING SHEETS AND APPARATUS FOR FORMING IMAGES PROVIDED WITH THE APPARATUS

BACKGROUND OF THE INVENTION

1. Field of the Invention

The present invention relates to a sheet processing apparatus for performing binding processing on sheets in the shape of a bunch, and more specifically, to a sheet processing apparatus for performing needle binding processing for binding a bunch of sheets using a needle and press binding processing for pressing a bunch of sheets to bind, and an image formation apparatus provided with the sheet processing apparatus.

2. Description of the Related Art

Conventionally, in image formation apparatuses such as a copier, laser beam printer, facsimile and complex apparatus thereof, there have been apparatuses provided with sheet processing apparatuses for performing various types of sheet processing such as binding processing on sheets with images formed. In such an image formation apparatus, in the case of binding a bunch of sheets with the sheet processing apparatus, it is general to bind a bunch of sheets using a staple made of metal.

However, in peeling a bunch of sheets subjected to binding processing using a staple, since it is necessary to remove the staple, work is not only burdensome, but also the sheet is easy to be broken. Therefore, a needleless binding mechanism is also known where a bunch of sheets is pressed with a press mechanism to mutually deform the sheets, and is bound, and it is possible to easily peel a bunch of thus press-bound sheets.

In Japanese Patent Application Publication No. 2016-10968 is disclosed a press bind mechanism where upper teeth and lower teeth are obliquely attached to a rotating shaft of an arm for supporting teeth, and gradually mesh with one another. According to this mechanism, since a bunch of sheets is gradually deformed along the rotation center of a support portion and is bound, in nipping sheets to start meshing, as shown in FIG. 13(*a*) of the above-mentioned publication, pressing is started from a beginning side, and it is thereby possible to reduce a maximum load required for press binding.

Further, a sheet processing apparatus is known which is equipped with a needle bind unit and press bind unit as a single bind apparatus so as to perform needle binding on a bunch of sheets in the case where the number of sheets to bind is high (for example, about 11 to 50) and to perform press binding in the case where the number is low (for example, about several).

For example, in an image formation apparatus of Japanese Patent Application Publication No. 2012-27118, a press bind unit with a relatively wide width and a needle bind unit (stapler) with a width narrower than the wide width are provided together, and are shifted integrally along a sheet end edge. Further, in a sheet processing apparatus of Japanese Patent Application Publication No. 2015-30584, a press binding member is provided so as to cover a needle binding member that rotates, and is configured to rotate about another shaft different from that of the needle binding member as the center, and the same drive motor is switched to perform press binding or needle binding.

SUMMARY OF THE INVENTION

However, in the needle bind unit used in actual products, since staples are installed as a cartridge, and are hammered by relatively strong force, the unit is large, and when the press bind unit is provided together, the entire apparatus is further upsized. Particularly, in the conventional apparatus as described in the above-mentioned Japanese Patent Application Publication No. 2012-27118, since the width of the press bind unit is set to be large, the size is increased in not only the bind apparatus itself but also the drive system for shifting the apparatus.

Further, in the conventional apparatus of Japanese Patent Application Publication No. 2015-30584, since the needle bind unit and press bind unit are arranged so as to stack vertically, bind positions of respective units are originally different from one another. Therefore, in the apparatus, two alignment references are provided in a sheet edge, and the sheet reference position is switched between needle binding and press binding. Consequently, the entire apparatus and its operation control is complicated.

In view of problems of conventional techniques as described above, in an apparatus disclosed herein, it is an object to provide a sheet processing apparatus for suppressing a dimension in a shift direction and enabling the entire apparatus to be miniaturized, while providing together a press bind unit beside a needle bind unit that shifts along a sheet edge and using the conventional needle bind unit, and an image formation apparatus.

The apparatus disclosed herein is provided with a placement tray to place sheets to undergo binding processing, and a bind unit that is able to shift along an end edge of sheets on the placement tray and that binds a plurality of sheets as a single bunch, where in the bind unit, a needle bind unit for performing binding processing on a bunch of sheets with a needle and a needleless bind unit for performing binding processing without a needle are provided together in a shift direction of the bind unit, and a length of the needleless bind unit is configured to be shorter than a length of the needle bind unit in the shift direction of the bind unit.

According to this configuration, it is possible to provide the apparatus which suppresses the dimension in the shift direction of the bind unit with the needle bind unit and press bind unit provided together in the shift direction along the sheet edge, and which is capable of actualizing miniaturization of the entire apparatus.

Further, the apparatus is provided with a placement tray to place sheets to undergo binding processing, and a bind unit that is able to shift along an end edge of sheets on the placement tray and that binds a plurality of sheets as a single bunch, where in the bind unit, a needle bind unit for performing binding processing on a bunch of sheets with a needle and a needleless bind unit for performing binding processing without a needle are provided together in a shift direction of the bind unit, a length of the needleless bind unit is shorter than a length of the needle bind unit in the shift direction of the bind unit, and the apparatus is provided with a common drive motor for selectively performing binding processing with the needle bind unit and binding processing with the needleless bind unit.

According to this configuration, it is also possible to add and use the press bind unit with a width narrower than that of the needle bind unit in the shift direction, in the needle bind unit that has conventionally been used, and since the drive motor is common, it is possible to provide the apparatus capable of actualizing miniaturization of the bind unit with needle binding and press binding provided together.

DESCRIPTION OF THE EMBODIMENTS

Figure 1:
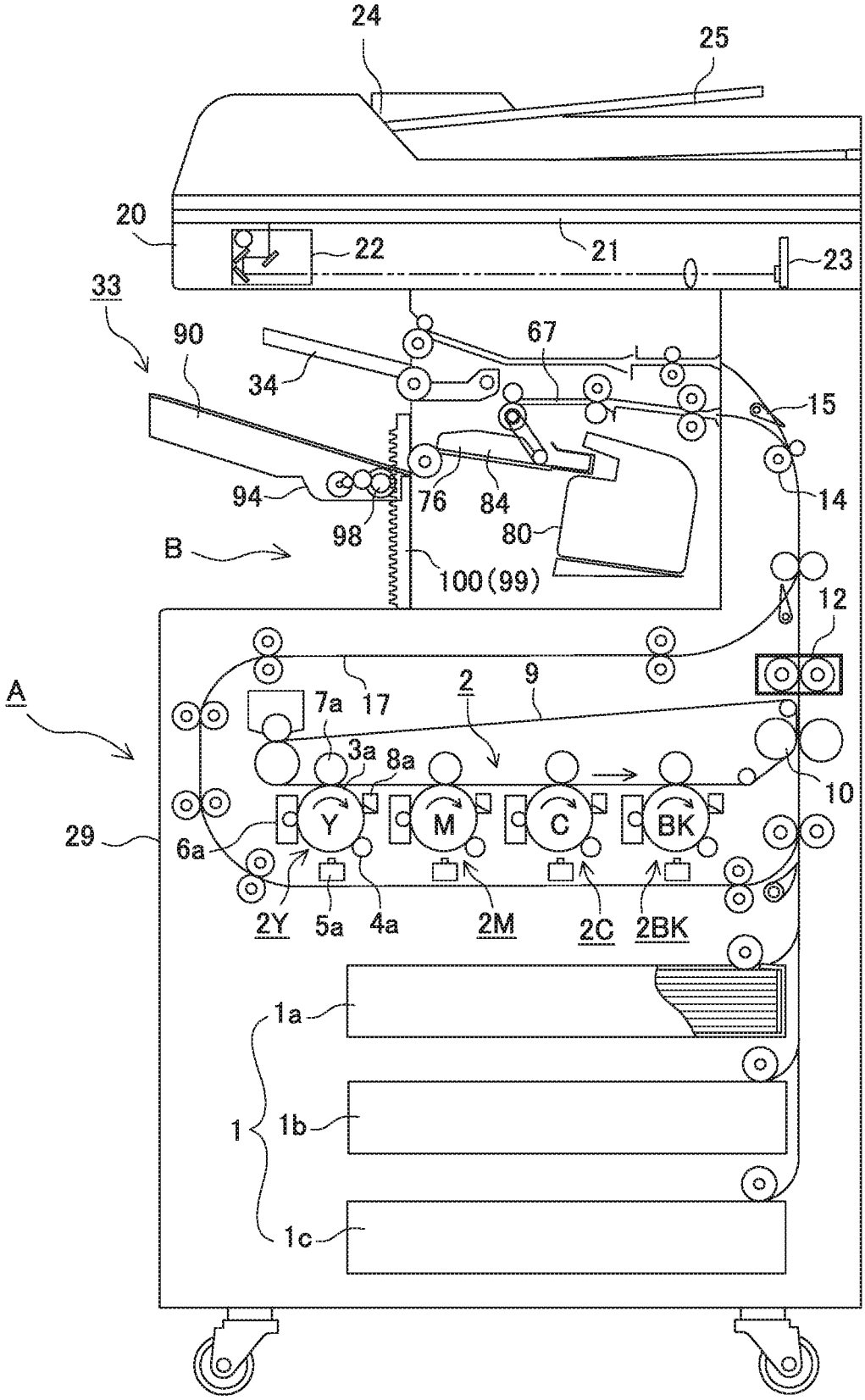
FIG. 1 is an entire configuration view of an image formation system provided with a sheet processing apparatus in Embodiment 1 of the present invention.

Referring to accompanying drawings, preferred Embodiments of the present invention will be described below in detail. In addition, in the accompanying drawings, through the entire present Description, similar components are assigned the same reference numerals to represent.

FIG. 1 schematically illustrates an entire configuration of an image formation system comprised of an image formation apparatus A and sheet processing apparatus B according to the present invention. The sheet processing apparatus B is to collate a plurality of sheets with images formed in the image formation apparatus A, and perform binding processing on a bunch of collected sheets. In addition, in the present Description, the front side of the image formation system of FIG. 1 i.e. the side facing a user of the image formation system is referred to as the front side, and the backside is referred to as the rear side.

[Image Formation Apparatus A]

In the image formation apparatus A shown in FIG. 1 are disposed a paper feed section 1 comprised of three-stage paper feed cassettes 1*a*, 1*b*, 1*c* to store sheets below an image formation section 2 using an electrophotographic scheme, and when the sheet processing apparatus B is not inserted, with space above the image formation section 2 being sheet discharge space, an image reading apparatus 20 is disposed above the space. Accordingly, when the sheet processing apparatus B is disposed, the apparatus is the so-called in-body type using the sheet discharge space as shown in the figure.

The image formation section 2 adopts a tandem scheme using an intermediate transfer belt. In other words, color components of four colors (yellow 2Y, magenta 2M, cyan 2C and black 2BK) are used. For example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image.

Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. By this configuration, the image is first-transferred to the intermediate transfer belt 9 for each color component. Then, the color component left on the photoconductor drum 3*a* is collected by a photoconductor cleaner 8*a* to prepare for next image formation. These schemes are the same as in the other color components.

In addition, the image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner to prepare for next transfer.

Thus image-formed sheet is discharged to the sheet processing apparatus B from a discharge roller 14. When image formation is performed on both sides of a sheet, the sheet once transported to the sheet processing apparatus B side with a switch gate 15 is switched back, transported to a circulation path 17, and is fed to the image formation section 2 again to form an image on the backside of the sheet. Then, the sheet with the image thus formed on one side or both sides is transported to the sheet processing apparatus B through the discharge roller 14.

The image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter (for example, CCD) by irradiating using a scan unit 22, and the image is stored in a data storage section not shown. The stored image is formed on the sheet in the image formation section 2 as described above.

[Sheet Processing Apparatus]

Figure 2:
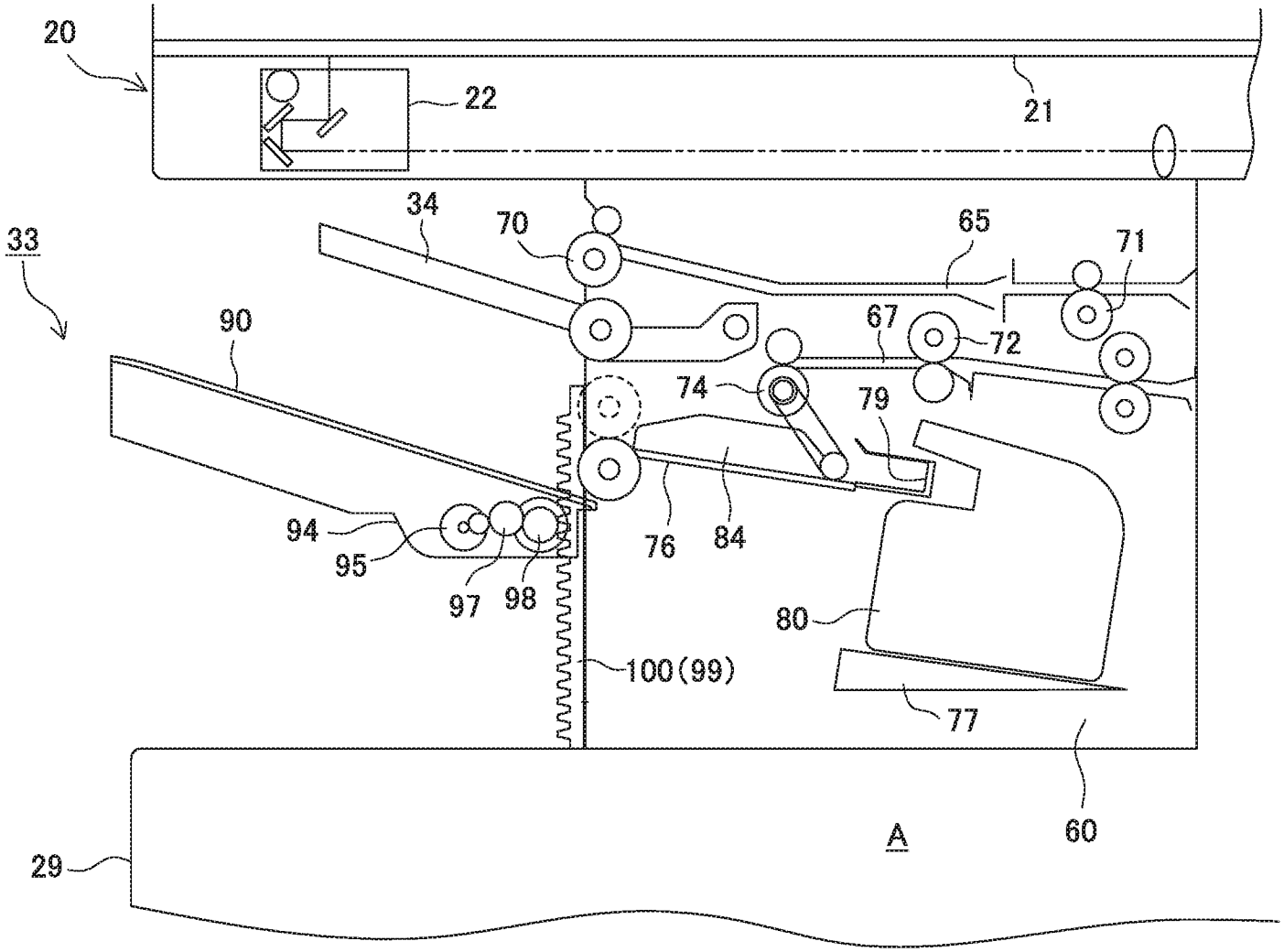
FIG. 2 is an enlarged view illustrating the sheet processing apparatus of FIG. 1.

The sheet processing apparatus B is disposed in the sheet discharge space below the image reading apparatus 20, above the image formation section 2. Then, as shown in FIG. 2, the sheet processing apparatus B is comprised of a switchback path 65, a sheet discharge path 67 for transporting an image-formed sheet sequentially fed from the image formation section 2 to perform sheet binding, a processing tray 76 to which the sheet from the sheet discharge path 67 is temporarily is introduced to place, a sheet bind apparatus 80 that binds a bunch of sheets ST (shown in FIG. 3) placed on the processing tray 76, and a tray unit 33 having a collection tray 90 which collects the bunch of sheets ST bound in the sheet bind apparatus 80 or discharged sheets without being bound and moves up and down. These apparatuses will be described below.

[Switchback Path]

As shown in FIG. 2, in the switchback path 65, a transport roller 71 is disposed on the entrance side, a discharge roller 70 is disposed on the exit side, and when the image formation section 2 forms an image also on the backside of the sheet, the path functions as a path to switch back the sheet. Then, as necessary, a sheet such as a thick sheet which is not suitable for both sides and binding processing in a sheet bind apparatus 32 is discharged to an escape tray 34 positioned above the tray unit 33 with the discharge roller 70.

[Tray Unit]

The tray unit 33 has the collection tray 90 which collects the bunch of sheets ST bound in the sheet bind apparatus 80 or discharged sheets without being bound and moves up and down. In the collection tray 90, an up-and-down pinion 98 of the collection tray 90 engages in an up-and-down rack 100 constituting a part of an up-and-down rail 99 that is a shift rail to rotate, and the tray thereby moves up and down. The up-and-down pinion 98 is driven by an up-and-down motor 95 disposed in an up-and-down motor installation portion 94 below the collection tray 90 via a transmission gear 97 and the like.

[Sheet Discharge Path]

The sheet discharge path 67 is formed linearly approximately in the horizontal direction, a carry-in roller pair 72 is disposed on the entrance side to couple to a sheet carrying-out outlet of the image formation section 2, and a sheet discharge roller pair 74 is disposed on the exit side. Then, the roller pair is driven by a drive motor, not shown, to transport a sheet.

[Processing Tray]

The processing tray 76 is provided as a placement tray to place sheets to undergo binding processing, and is provided with a regulation stopper 79 that regulates a position of the rear end portion in a sheet discharge direction (direction from the right to the left in FIG. 2) of the sheet. The sheet discharged from the sheet discharge path 67 is reversely transported in a direction (rightward in FIG. 2) opposite to the discharged direction by a transport means not shown, and is introduced to the processing tray 76. Thus fed sheet is regulated at its front end by the regulation stopper 79, and the front end position is aligned.

Figure 3:
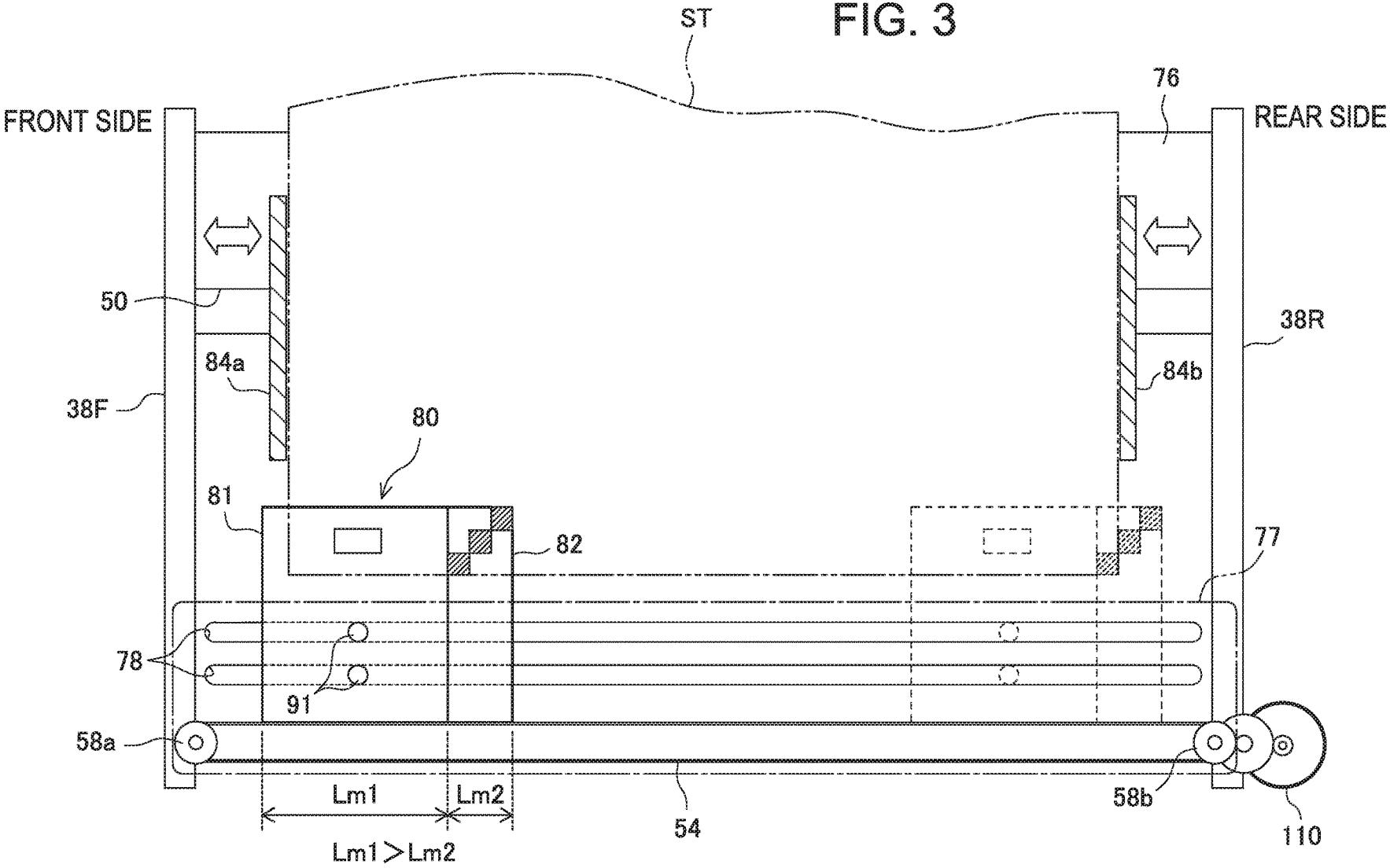
FIG. 3 is a plan view schematically illustrating an arrangement on a processing tray of a sheet bind apparatus with a needle bind unit and press bind unit integrated.

FIG. 3 shows a plan view of the processing tray 76, and the processing tray 76 is partition-formed with a front-side frame 38F and rear-side frame 38R. The processing tray 76 is provided with an alignment apparatus 84 to position the sheet, which is introduced toward the sheet bind apparatus 80 from the upper direction in FIG. 2 by the reverse transport, in a direction orthogonal to the transport direction. The alignment apparatus 84 has a pair of alignment plates 84*a*, 84*b* that are respectively disposed on the front side and rear side of the processing tray 76 and that move back and forth in the direction orthogonal to the transport direction.

Each of the alignment plates 84*a*, 84*b* is provided as an alignment member for aligning the position of the sheet on the processing tray 76 in the shift direction of the sheet bind apparatus 80, engages in a guide groove 50 formed in the direction orthogonal to the sheet transport direction in a sheet support surface of the processing tray 76, slides in the guide groove 50, and is supported to be able to shift. It is possible to shift the alignment plates 84*a*, 84*b* individually with an alignment plate drive mechanism not shown. For example, each of the alignment plates 84*a*, 84*b* is held by a belt looped between pulleys disposed on the front side and the rear side respectively, the belt is driven by an alignment motor disposed on the front side or the rear side respectively, and it is thereby possible to shift as described above.

[Sheet Bind Apparatus]

Figure 4:
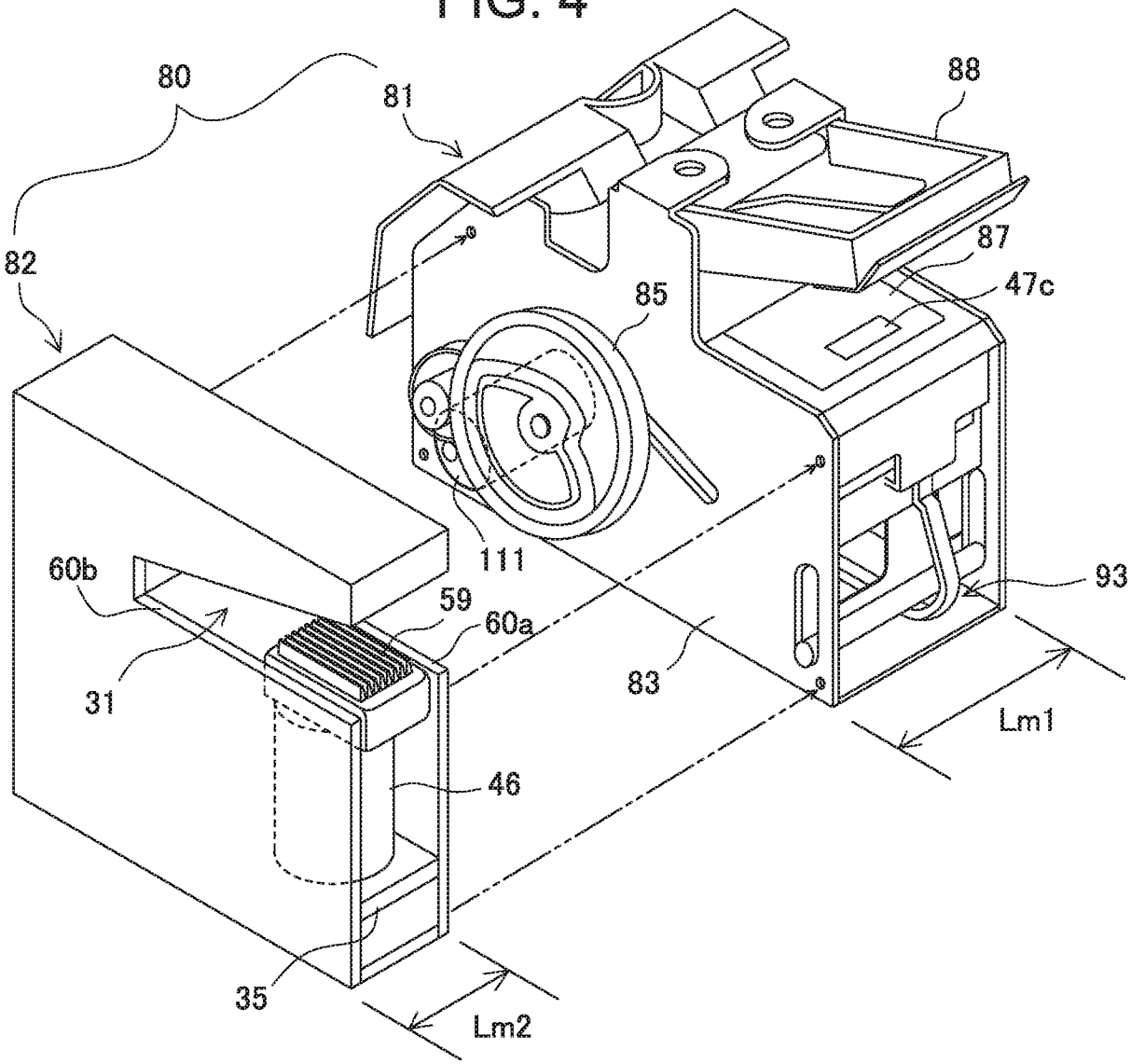
FIG. 4 is a perspective view illustrating a position relationship between the needle bind unit and the press bind unit provided together.

As shown in FIG. 4, the sheet bind apparatus 80 is configured integrally by arranging a needle bind unit 81 and press bind unit 82 parallel in the lateral direction. As shown in FIGS. 2 and 3, the sheet bind apparatus 80 is disposed on the front end side of the processing tray 76 i.e. near the end edge on the side opposite to the collection tray 90, where the front, which is the side to receive a sheet to undergo binding processing, of the needle bind unit 81 and press bind unit 82 faces the processing tray 76 side.

Below the front end-side end portion of the processing tray 76 is provided a shift bench 77 of the sheet bind apparatus 80 which extends over the entire width at least in the right-and-left direction (i.e. from the front side to the rear side). In the shift bench 77 is formed a pair of parallel grooves 78 extending over substantially the entire width in the right-and-left direction. The sheet bind apparatus 80 is installed on the shift bench 77 by respectively fitting a pair of protrusions 91 provided in its bottom portion into the grooves 78 slidably.

In the frames 38F, 38R are disposed a pair of left and right pulleys 58*a*, 58*b*, and a timing belt 54 (belt with teeth) is looped between the pulleys. To one of the pulleys 58*b* is coupled a bind unit shift motor 110. The sheet bind apparatus 80 is coupled to the timing belt 54, and by driving the bind unit shift motor 110, is capable of reciprocating and shifting in the right-and-left direction on the shift bench 77.

In this Embodiment, a breadth of the press bind unit 82 constituting the sheet bind apparatus 80 i.e. a dimension in its shift direction is set to be smaller than a breadth of the needle bind unit 81 constituting the sheet bind apparatus 80 similarly. In other words, in FIGS. 3 and 4, when it is assumed that the breadth of the press bind unit 82 is Lm2, and that the breadth of the needle bind unit 81 is Lm1, it is set that Lm2<Lm1. For example, when the breadth Lm1 of the needle bind unit 81 is about 60 mm, it is possible to set the breadth Lm2 of the press bind unit 82 at about 15 mm.

By this means, as the needle bind unit 81, also in adopting a general apparatus•mechanism that have conventionally been used as described later, it is possible to suppress the dimension not to be excess in the shift direction of the sheet bind apparatus 80 provided with the needle bind unit 81 and press bind apparatus 82 together, and to make the apparatus smaller than at least the same type of conventional sheet bind apparatus. By this means, it is possible to suppress upsizing of the sheet processing apparatus B itself, and to concurrently suppress manufacturing costs by using the conventional general needle bind unit.

[Needle Bind Unit]

As the needle bind unit 81 are used various types conventionally known as the apparatus for performing binding processing with staples. For example, in the needle bind unit 81 shown in FIG. 4, a needle bind motor 111 is stored inside a unit frame 83 forming a contour of the unit, and on the side surface of the unit frame 83 is disposed a drive cam 85 that is driven to rotate by the needle bind motor 111.

In the lower portion of the unit frame 83 is provided a drive mechanism portion 93 that drives a staple formed in the shape of a C toward a bunch of sheets ST on the processing tray 76 to be driven by the drive cam 85. On the upper surface of the unit frame 83 is formed a table 87 to place a bind portion of the bunch of sheets ST on the processing tray 76. The drive mechanism portion 93 drives a staple upward from the lower surface side of the table 87 toward the bunch of sheets ST disposed on the table 87.

In the upper portion of the unit frame 83 is provided a clincher mechanism portion 88 that bends the staple legs, which are driven by the drive mechanism portion 93 and penetrate the top surface side of the bunch of sheets ST on the table 87, along the top surface of the bunch of sheets ST. In the clincher mechanism portion 88, a rear end portion is pivotally fitted into the unit frame 83, and the bunch of sheets ST disposed on the table 87 is nipped between the top surface of the table 87 and the clincher mechanism portion 88.

Further, in the clincher mechanism portion 88 is formed a cutter unit (not shown) that cuts front end portions of the staple legs which penetrate the bunch of sheets ST and protrude upward. By the cutter unit, the front end portions of the staple legs are cut to make lengths protruding from the bunch of sheets certain, and subsequently, the clincher mechanism portion 88 bends the staple legs along the top surface of the bunch of sheets ST to perform staple binding.

Between the table 87 and the clincher mechanism portion 88 is defined an opening portion of sufficient dimensions to place the number of sheets capable of undergoing needle binding with the needle bind unit 81. Accordingly, it is possible to shift the needle bind unit 81 smoothly in the right-and-left direction in a state in which a bunch of sheets to undergo binding processing or subjected to binding processing is placed on the table 87, without the bunch of sheets being caught or damaged.

[Press Bind Unit]

The press bind unit 82 performs press binding for pressing a bunch of sheets ST from both the frontside and the backside between press teeth each having a concavo-convex surface and thereby deforming to bind. Therefore, the press bind unit 82 is provided with a press bind mechanism which presses and deforms a bind portion of the bunch of sheets ST to bind, and a press drive mechanism which drives the press bind mechanism to perform press binding.

Figure 5A:
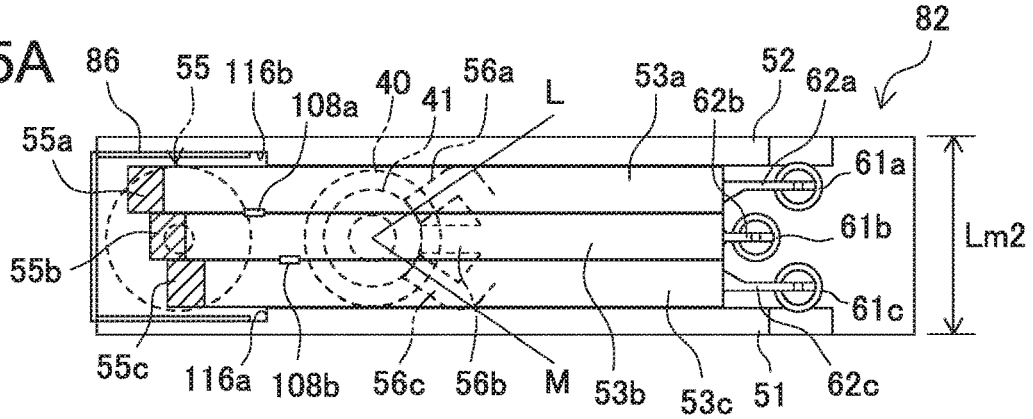
FIG. 5A is a plan view schematically illustrating a configuration of the press bind unit.
Figure 5B:
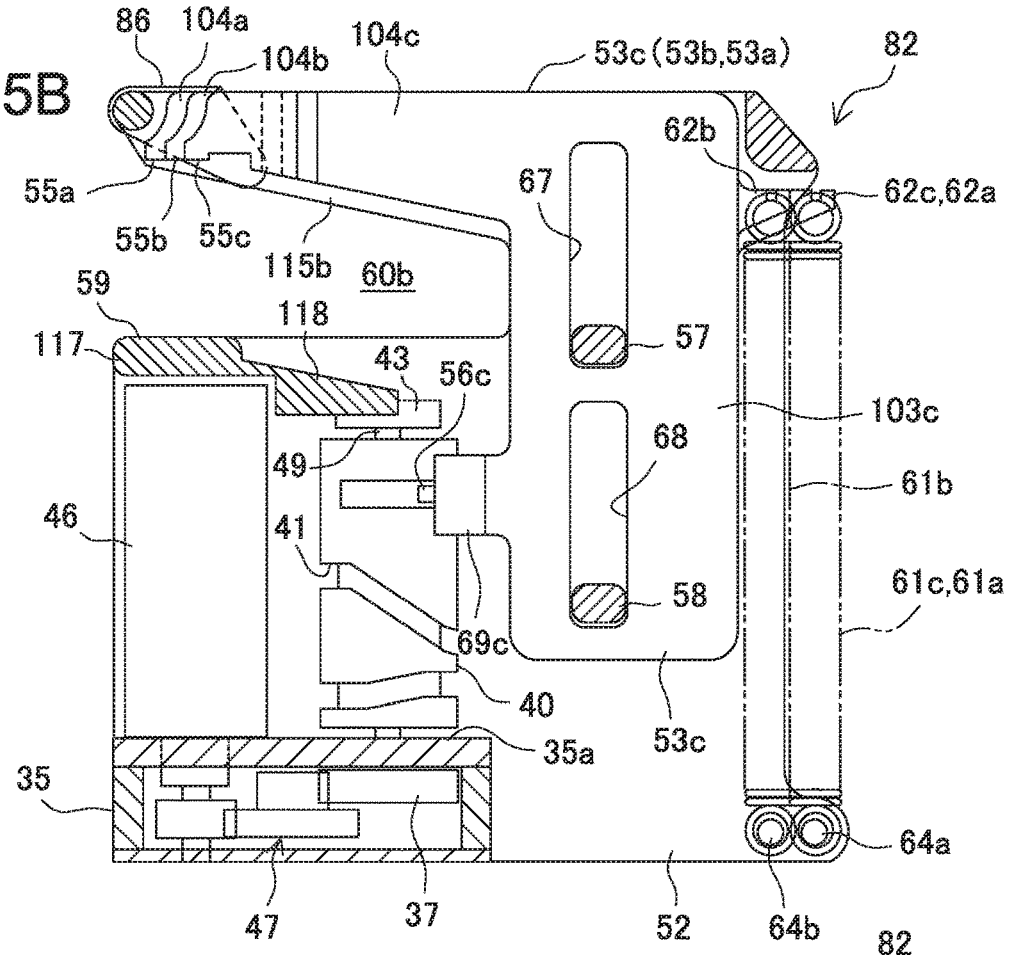
FIG. 5B is a partial sectional side elevational view.
Figure 5C:
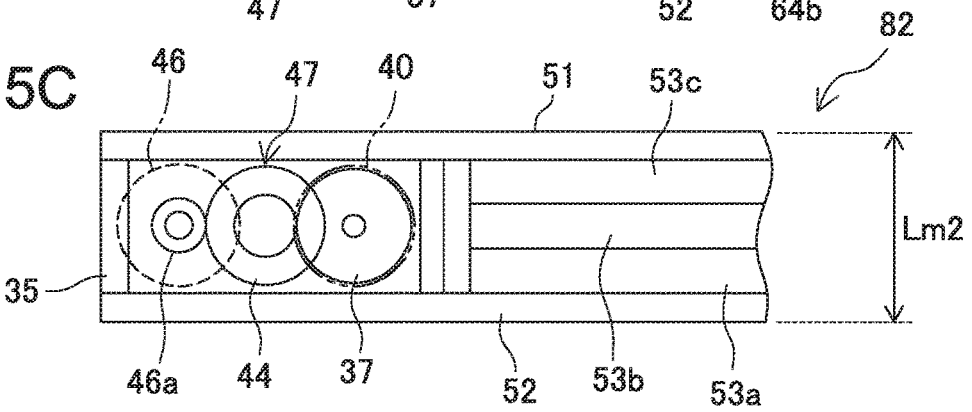
FIG. 5C is a bottom view.

FIGS. 5A to 5C schematically illustrate the entire configuration of the press bind unit 82. The press bind mechanism of the press bind unit 82 is comprised of a front plate 51, a base plate 52, three pressing plates 53*a*, 53*b*, 53*c*, and press teeth comprised of pressing teeth 55*a*, 55*b*, 55*c* and receiving tooth 59. The press drive mechanism is comprised of a press bind motor 46, pressing springs 61*a*, 61*b*, 61*c*, a cam mechanism that drives the pressing plates, and a gear mechanism that connects between the press bind motor and the cam mechanism so as to enable a drive force to be transferred.

[Press Bind Mechanism]

As shown in FIG. 5A, three pressing plates 53*a* to 53*c* each of which is a plate member are overlapped mutually in the width direction of the press bind unit 82, the front plate 51 and base plate 52 are further overlapped to sandwich the plates from the opposite sides, and the plates are mounted. The pressing plates 53*a* to 53*c* are provided slidably in an in-plane direction mutually and between the front plate 51 and the base plate 52, particularly, in the in-plane vertical direction. In this Embodiment, a thickness of each of the pressing plates 53*a* to 53*c*, front plate 51 and base plate 52 is set at the order, at most, of several millimeters, and preferably about 3 mm, and it is thereby possible to make the width dimension Lm2 of the entire press bind unit 82 significantly shorter than the conventional same type of needleless bind apparatus.

Figure 8:
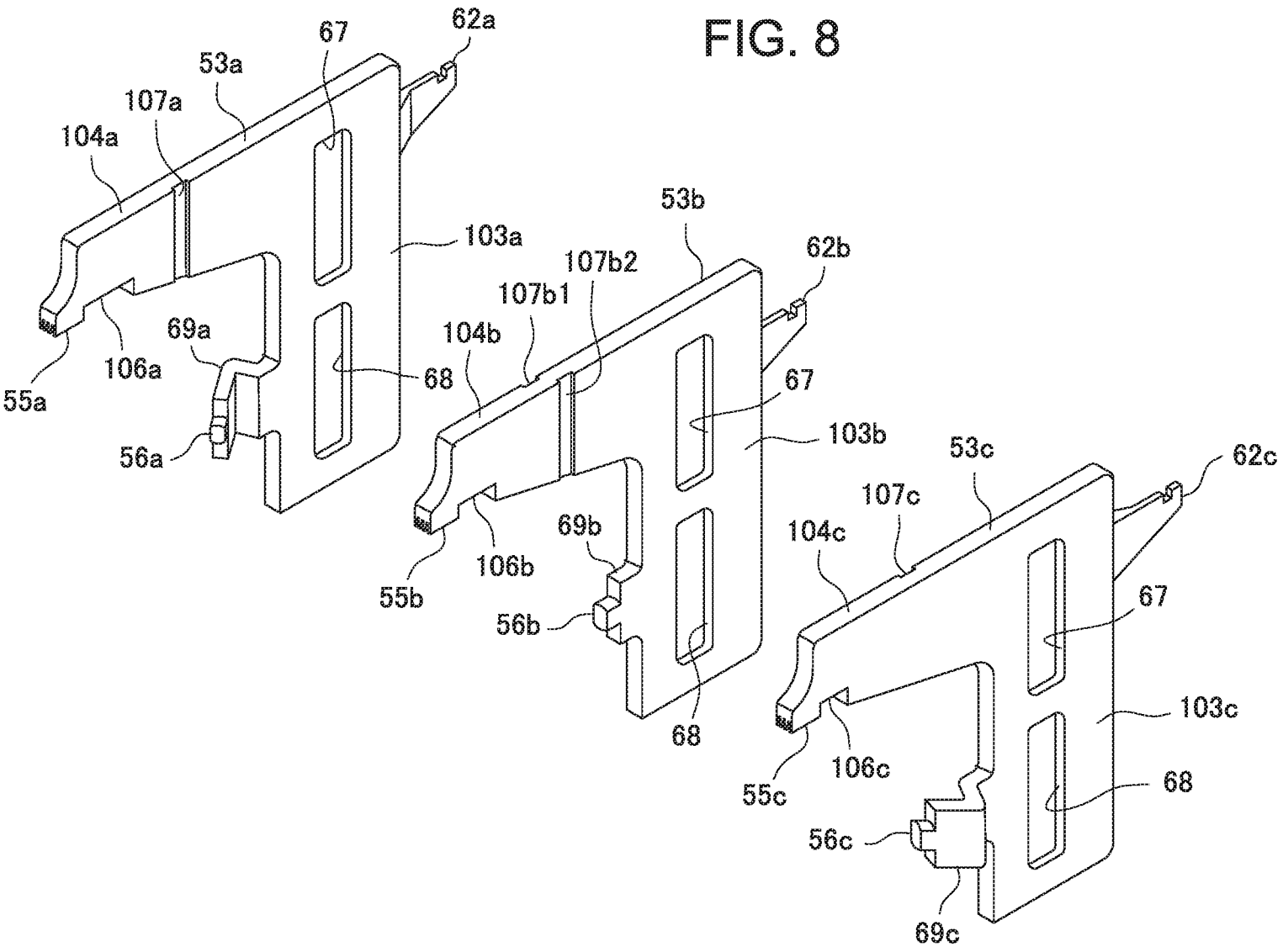
FIG. 8 is an exploded perspective view of pressing plates respectively on the rear side, center and front side disposed between a front plate and the base plate.

As shown in FIG. 8, each of the pressing plates 53*a* to 53*c* is formed of a relatively thin plate-shaped member forming the shape of an inverse L. Both the frontside and the backside of each of the pressing plates 53*a* to 53*c* are formed with smoothness so as to enable opposite surfaces of the other adjacent plate, front plate 51 or base plate 52 to slide. The pressing plates have movable base portions 103*a* to 103*c* each forming a substantially vertically long rectangle on the right side in the figure, and pressing arm portions 104*a* to 104*c* that extend from the upper portion of the base portion to the left side in the figure i.e. to the front side of the press bind unit 82, respectively.

In each of the movable base portions 103*a* to 103*c*, a pair of guide slots 67, 68 each extending in the vertical direction in the figure is provided to penetrate in the same line in the vertical direction. Follower pins 56*a* to 56*c* are provided at front ends of pin support portions 69*a* to 69*c* to protrude via the portions 69*a* to 69*c*, in the side on the pressing arm portion side of the movable base portions 103*a* to 103*c*, respectively. In the side on the side opposite to the pressing arm portions 104*a* to 104*c* of the movable base portions 103*a* to 103*c*, spring fastening portions 62*a* to 62*c* to fasten upper ends of the pressing springs are provided to protrude in the direction opposite to the pressing arm portions near the upper ends, respectively.

FIG. 5B illustrates a state in which upper sides of the movable base portions 103*a* to 103*c* and sides on the pressing arm portions 104*a* to 104*c* side are aligned, and the pressing plates 53*a* to 53*c* are installed in the base plate 52.

As shown in FIG. 5B, in the movable base portions 103*a* to 103*c*, respective lengths in the vertical direction i.e. heights, and lengths in the right-and-left direction i.e. widths except the spring fastening portions 62*a* to 62*c* in the figure are the same. The spring fastening portions 62*a*, 62*c* of the pressing plates 53*a*, 53*c* on the front side and rear side have the same width, and in contrast thereto, the spring fastening portion 62*b* of the center pressing plate 53*b* is formed to be slightly shorter than the portions 62*a*, 62*c*. Therefore, the center spring fastening portion 62*b* is displaced and disposed in a dented position on the pressing arm portion side from the other spring fastening portions 62*a*, 62*c*.

Further, the guide slots 67, 68 respectively of the movable base portions 103*a* to 103*c* are formed in the same length and same certain width, and are disposed to mutually overlap completely in the installation state of FIG. 5B. Further, the cam follower pins 56*a* to 56*c* are formed in the same shape and dimension in cross section, and are disposed to be the same heights as one another in the installation state of FIG. 5B.

As shown in FIGS. 5B and 8, in the pressing arm portions 104*a* to 104*c*, pressing teeth 55*a* to 55*c* are formed integrally in lower edges of respective front end portions. Further, in the lower edges of the pressing arm portions 104*a* to 104*c*, as shown in FIG. 8, concave portions 106*a* to 106*c* with a predetermined length are formed on the movable base portion side immediately near the pressing teeth 55*a* to 55*c*, as clearances so as not to contact a portion of a bunch of sheets in the periphery thereof in pressing a bind portion of the bunch of sheets with the pressing teeth.

Further, in the pressing arm portions 104*a* to 104*c*, thin grooves 107*a*, 107*b*1, 107*b*2 and 107*c* crossing the pressing arm portions vertically in concave shapes are provided in surfaces opposed to adjacent other pressing arm portions 104*a* to 104*c*. The thin grooves 107*a* and 107*b*1, and 107*b*2 and 107*c* of opposed surfaces are mutually aligned in the longitudinal direction of the pressing arm portions, and are disposed to each define a single thin vertical through hole 108*a* or 108*b* in the installation state of FIG. 5A, respectively.

The adjacent pressing plates 53*a* to 53*c* shift relatively in a state in which opposed surfaces are in slide-contact with one another, and therefore, it is preferable that the opposed surfaces are beforehand coated with a lubricant such as, for example, grease. At this point, when the lubricant reaches the front ends of the pressing arm portions 104*a* to 104*c* through the opposed surfaces, there is the risk that the lubricant adheres to sheets to undergo binding processing and soils. The vertical through holes 108*a*, 108*b* in this Embodiment prevent the lubricant from going ahead thereof and reaching the front ends of the pressing arm portions 104*a* to 104*c*, as an oil thrower.

As shown in FIG. 5B, the pressing arm portions 104*a* to 104*c* are formed so that their lengths in the extension direction are gradually longer on the back side than on the front side in the figure, i.e. on the rear side than on the front side. By this means, as shown in FIG. 5A, the pressing teeth 55*a* to 55*c* in the front ends of the pressing arm portions are provided so that the position shifts in the extension direction, while slightly overlapping. On the other hand, other portions of the pressing arm portions 104*a* to 104*c* including the concave portions 106*a* to 106*c* are provided to overlap in the installation state of FIG. 5B.

Figure 9:
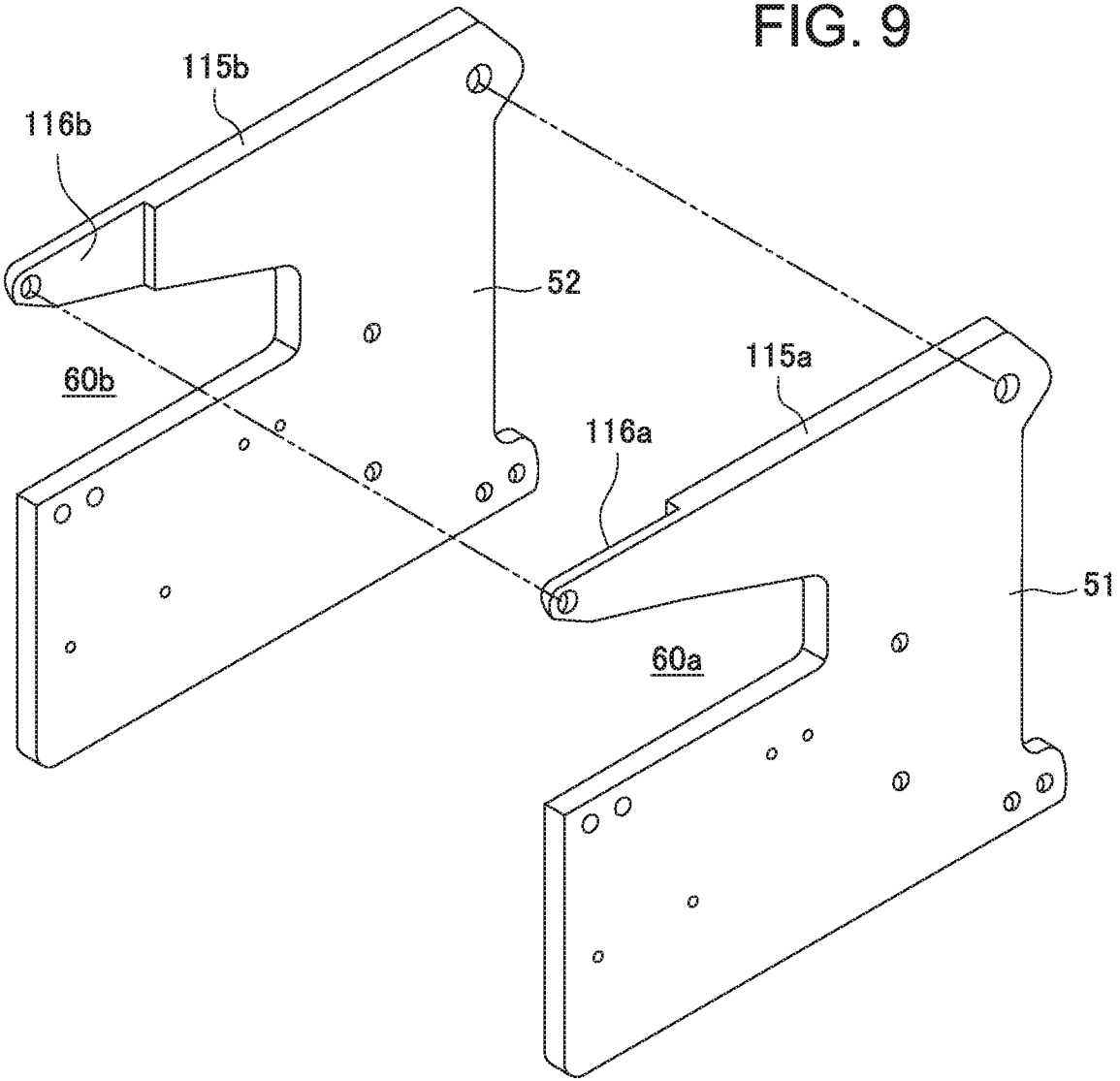
FIG. 9 is a perspective view illustrating a position relationship between the front plate and the base plate.

As shown in FIG. 9, the front plate 51 and base plate 52 are formed of a pair of substantially flat plate members mutually forming plane symmetry in the installation state of FIG. 5A. At the tops of the front plate 51 and base plate 52 are formed fixed arm portions 115*a*, 115*b* extending to the front side of the press bind unit 82. As shown in FIG. 5B, the fixed arm portions 115*a*, 115*b* are provided substantially in the same shape as the pressing arm portions 104*a* to 104*c*, while being slightly larger than the portions 104*a* to 104 so as to cover the pressing arm portions.

Figure 10:
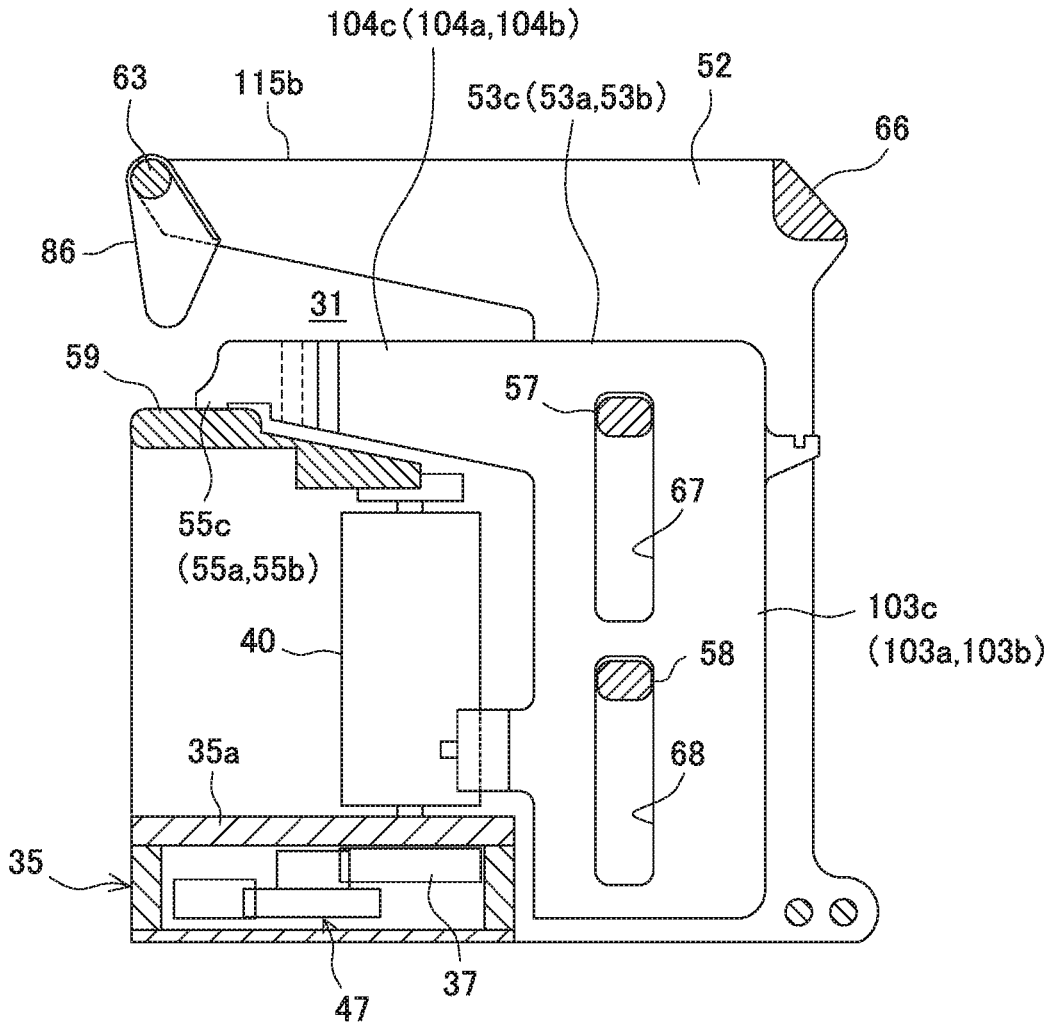
FIG. 10 is an explanatory view of a press position in which a pressing tooth is pressed against a receiving tooth.

Below the fixed arm portions 115*a*, 115*b* of the front plate 51 and base plate 52 are formed notches 60*a*, 60*b* with the same shape in the form of a wedge largely opened to the front side of the press bind unit 82. The lower sides of the notches 60*a*, 60*b* are formed in the shape of a straight line approximately parallel with a sheet placement surface of the processing tray 76 when the front of the press bind unit 82 is disposed on the tray 76 side. Accordingly, by the notches 60*a*, 60*b*, as shown in FIGS. 4 and 10, a placement portion 31 is defined which is space to place a bind portion of a bunch of sheets ST to undergo press binding.

An opening height i.e. dimension in the vertical direction of the notches 60*a*, 60*b* is set to be larger than at least a thickness of the number of a bunch of sheets capable of undergoing needle binding with the needle binding unit 81, and is preferably set to provide sufficient allowance with respect to the thickness, in a range in which at least the bunch of sheets to undergo binding processing is placed or passes. A depth of the notches 60*a*, 60*b* is set at a dimension enough to place or pass a side portion of a bunch of sheets to undergo binding processing. For example, it is possible to set the notches 60*a*, 60*b* at substantially the same dimensions as those of the opening portion defined between the table 87 and the clincher mechanism portion 88 of the needle bind unit 81.

Figure 7:
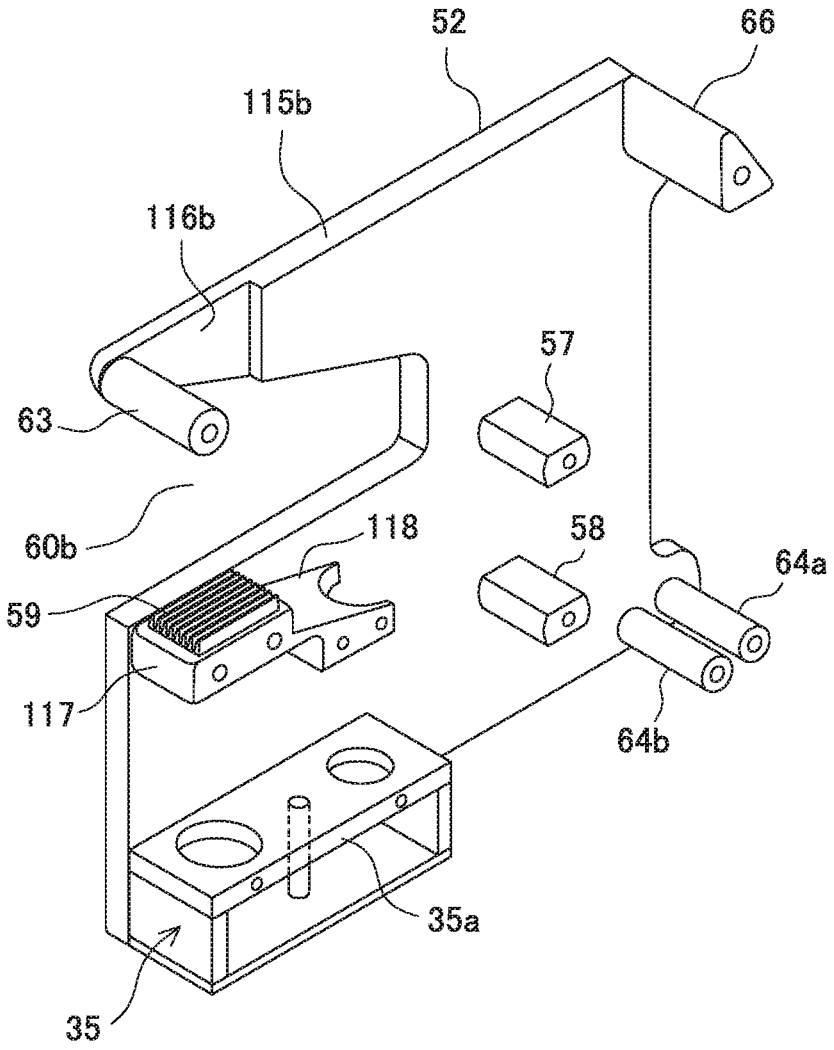
FIG. 7 is a perspective view of a base plate without the drive system.

In the base plate 52, as shown in FIG. 7, in the surface opposed to the front plate 51, a joint pin 63 is provided at the front end of the fixed arm portion 115*b*, two joint pins 64*a*, 64*b* are provided in a position diagonally opposite thereto at the lower end on the right side in the figure, and a joint rod 66 is provided at the upper end on the right side in the figure above the pins so that each of the pins and rod protrudes in the same height. The front plate 51 is positioned in front ends of the joint pin 63, joint pins 64*a*, 64*b* and joint rod 66 and is integrally fixed with appropriate fasteners such as bolts, and a certain gap is thereby defined to install the pressing plates 53*a* to 53*c* in between the plate 51 and the base plate 52.

Further, two upper and lower guide pins 57, 58 are provided to protrude in the surface opposed to the front plate 51 of the base plate 52. The pressing plates 53*a* to 53*c* are installed in the base plate 52 in order of the rear side, center and front side, by fitting the guide slots 67, 68 into the guide pins 57, 58, respectively. The guide pins 57, 58 are provided to fit slidably only in the longitudinal direction, substantially without play in its width direction. By this means, the pressing plates 53*a* to 53*c* are held in the gap between the base plate 52 and the front plate 51 to be slidable only in the in-phase vertical direction.

Further, on the lower-side side near the opening end of the notch 60*b*, a fix support portion 117 of the receiving tooth 59 is integrally bonded to the base plate 52. On the top surface of the fix support portion 117, the receiving tooth 59 is integrally provided in an appropriate shape in a tooth formation region of a plane rectangle with the direction of the lower side as long sides. The receiving tooth 59 is disposed so as to face the pressing teeth 55*a* to 55*c* at the front ends of the pressing arm portions 104*a* to 104*c* disposed above.

In the fix support portion 117, a bearing support portion 118 of the cam mechanism is integrally formed so as to extend obliquely downward from the end portion on the side opposite to the opening end of the notch 60*b*, and is similarly integrally bonded to the base plate 52. Further, below the fix support portion 117, a press bind drive portion base 35 to attach the press drive mechanism except the pressing spring is integrally bonded along the lower side of the base plate 52.

The guide pins 57, 58, fix support portion 117, bearing support portion 118 and press bind drive portion base 35 have the same height as that of the joint pin 63, joint pins 64*a*, 64*b* and joint rod 66. In attaching to the base plate 52, the front plate 51 is integrally fixed to the guide pins 57, 58, fix support portion 117, bearing support portion 118, press bind drive portion base 35, joint pins 63, 64*a*, 64*b* and joint rod 66 with appropriate fasteners such as bolts. Thus, the entire press drive mechanism including the pressing spring as described later is stored in the gap between the front plate 51 and the base plate 52.

In the receiving tooth 59, with the direction orthogonal to the lower side being as an alignment direction of the tooth, a plurality of upward projections in the shape of ribs extending in the lower side direction, and concave grooves in the shape adapted thereto are formed alternately. The receiving tooth 59 is comprised of linear projections and concave grooves in this Embodiment, and is capable of adopting various concavo-convex shapes. Further, the alignment direction of the tooth is not limited to the direction orthogonal to the lower side direction.

As described later, the pressing teeth 55*a* to 55*c* that sequentially mesh with the receiving tooth 59 constitute the pressing tooth that corresponds to the receiving tooth 59, with three teeth continuous from the front side to the rear side as a single member. Each of the pressing teeth 55*a* to 55*c* is provided in an appropriate shape integrally in a tooth formation region of a plane rectangle smaller than the tooth formation region of the receiving tooth 59, with the extension direction of the pressing arm portion as the long side, in the lower surfaces of the front end portions of the pressing arm portions 104*a* to 104*c*.

In the pressing teeth 55*a* to 55*c*, with the thickness direction of the pressing arm portions 104*a* to 104*c* as an alignment direction of teeth respectively, a plurality of downward projections in the shape of ribs extending in the direction orthogonal to the alignment direction, and concave grooves in the shape adapted thereto are formed alternately. The downward projections and concave grooves of the pressing teeth 55*a* to 55*c* have the shape and dimensions capable of meshing with the upward projections and concave grooves of the receiving tooth 59.

In this Embodiment, in each of the pressing teeth 55*a* to 55*c*, the dimension in the alignment direction of the tooth is set at approximately ⅓ the dimension in the alignment direction of the tooth of the receiving tooth 59. When it is considered that the tooth formation region of the receiving tooth 59 is divided into three in the alignment direction of the tooth, the pressing teeth 55*a* to 55*c* respectively correspond to receiving tooth portions on the front side, center and rear side. Accordingly, when the pressing plates 53*a* to 53*c* are moved down along the guide slots 67, 68 that respectively engage in the guide pins 57, 58, the pressing teeth 55*a* to 55*c* on the front side, center and rear side mesh with the receiving tooth 59 in respective corresponding receiving tooth portions.

Further, as described above, the pressing teeth 55*a* to 55*c* are disposed, while partially overlapping and shifting the position from the front side to the rear side in the extension direction of the pressing arm portions 104*a* to 104*c*. Accordingly, the pressing teeth 55*a* to 55*c* mesh with the receiving tooth 59 in a straight line in the diagonal direction for connecting a corner portion on the notch back side on the front side of the top surface of the receiving tooth 59 and a corner portion on the notch opening side on the rear side of the top surface. As a result, press traces in the shape of steps inclined in the diagonal direction are formed in a bind portion of a bunch of sheets subjected to press binding with the press bind unit 82.

In another Embodiment, it is possible to form press traces by the receiving tooth 59 and the pressing teeth 55*a* to 55*c* in the shape of steps inclined along another diagonal direction on the top surface of the receiving tooth 59, in a checkered pattern where the position in the long side direction on the top surface of the receiving tooth 59 is alternately changed between the front side and the rear side, or linearly in the arrangement direction of the tooth of the receiving tooth 59. For example, it is possible to form these traces by changing lengths in the extension direction of the pressing arm portions 104*a* to 104*c*, or changing the position in the extension direction of the pressing arm portion of each of the pressing teeth 55*a* to 55*c*.

Further, by arranging the pressing teeth 55*a* to 55*c* discontinuously mutually in the alignment direction of the tooth and in the extension direction of the projection, it is possible to form three discontinuous press traces between the receiving tooth 59 and the teeth 55*a* to 55*c*. For example, it is possible to form the traces, by making the dimension in the alignment direction of the tooth of the pressing teeth 55*a* to 55*c* smaller than the plate thickness of the pressing plates 53*a* to 53*c*, and/or setting positions in the extension direction of the pressing arm portions of the pressing teeth 55*a* to 55*c* not to overlap one another.

Furthermore, the tooth formation region of each of the pressing teeth 55*a* to 55*c* is not limited to the same dimension. For example, it is possible to set the pressing teeth 55*a* to 55*c* so that three plane dimensions of respective tooth formation regions mutually differ from one another, or only one of the dimensions differs from the others.

Still furthermore, the number of the pressing plates 53*a* to 53*c* is not limited to three, and may be two, or four or more. Moreover, it is also possible to provide a single pressing plate with two or more pressing teeth. In this case, it is possible to arrange a plurality of pressing teeth separately along the lower side of a single pressing plate and/or in the thickness direction of the lower side of the pressing plate.

As a matter of course, with respect to the projections and concave grooves of the receiving tooth 59 and pressing teeth 55*a* to 55*c*, it is possible to form various forms different from those in the above-mentioned Embodiments. For example, it is also possible to form the projections in the shape of slating linear ribs with respect to the alignment direction of the tooth, the shape of a V bent at some midpoint, or curved waveform.

Figure 6B:
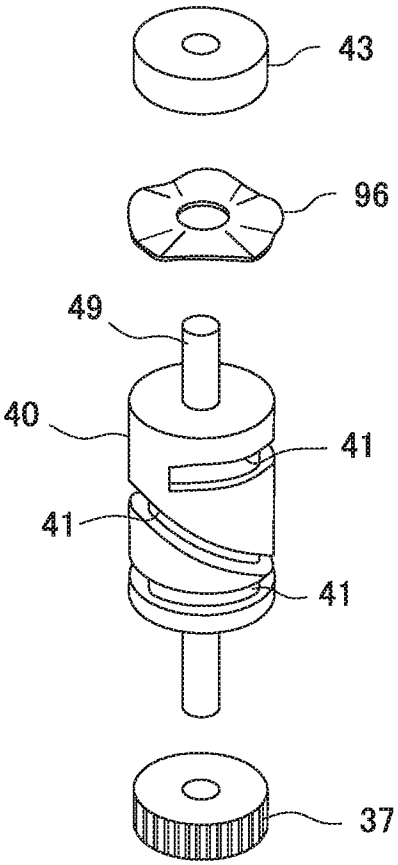
FIG. 6B is an exploded perspective view illustrating a cylindrical cam and components related thereto.
Figure 6A:
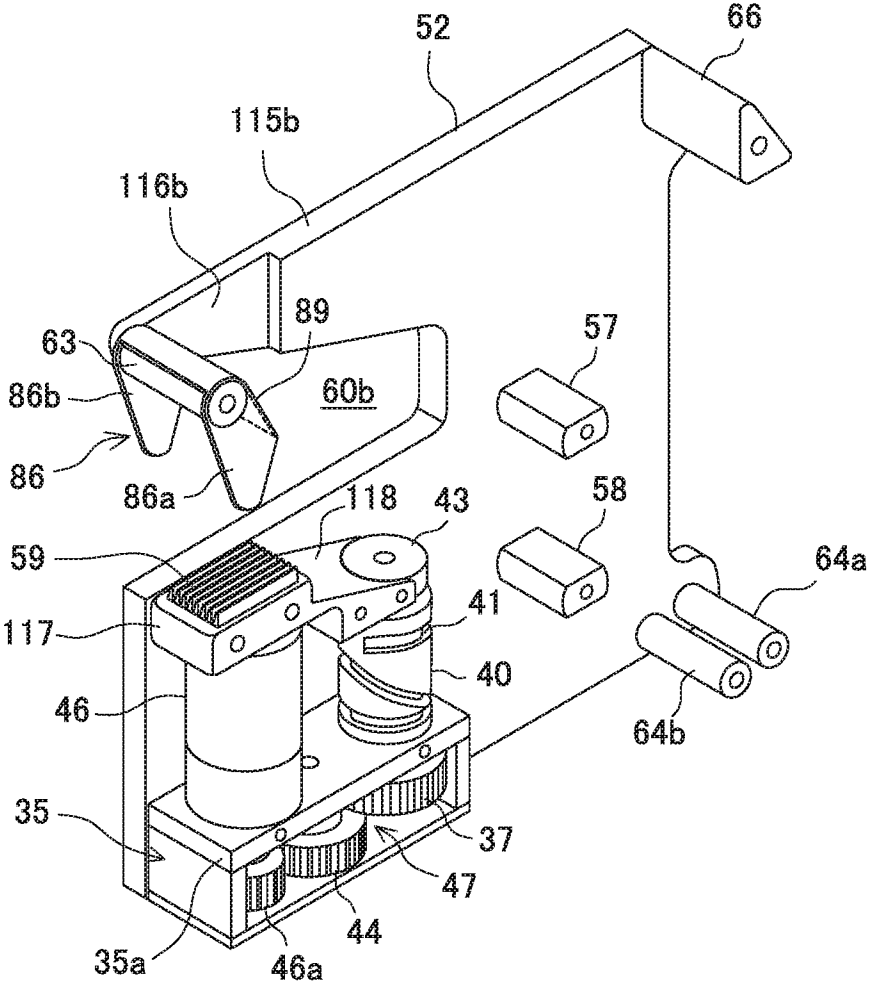
FIG. 6A is a perspective view illustrating a drive system of the press bind unit.

As shown in FIG. 6A, at the front end of the fixed arm portion 115*b* of the base plate 52, a sheet guide 86 is provided swingably by the joint pin 63. The sheet guide 86 is provided to partially limit an opening height of the notch from above so as to guide a bunch of sheets, which undergoes press binding with the press bind unit 82, to the placement portion 31 inside the notches 60*a*, 60*b* smoothly, without fluttering the front end portion of the bunch of sheets vertically.

The sheet guide 86 has a pair of guide pieces 86*a*, 86*b* with the same shape and dimensions which are disposed parallel and symmetrically at a predetermined separation distance, and an engagement plate portion 89 that joins the pieces. Each of the guide pieces 86*a*, 86*b* is made of a thin plate forming an approximately isosceles triangle where the vertex is relatively large. The engagement plate portion 89 is made of a thin plate that connects one of equilateral portions of the isosceles triangle continuously from near the vertex portion to near the base angle portion, and is formed integrally with both the guide pieces.

The sheet guide 86 is pivotally fitted into the joint pin 63 in the base angle portion on the side where the engagement plate portion 89 is provided, with the base of the isosceles triangle being on the opening side of the notch 60*b*. The sheet guide 86 is attached with the base of the isosceles triangle inclined obliquely downward to the back side of the notch in a state of naturally hanging from the joint pin 63 under its own weight. By this means, even when the front end portion of the sheet entering inside the notch comes into contact with the sheet guide 86, the sheet is guided downward toward the placement portion 31, without being caught or damaged.

The sheet guide 86 is provided so as to vary its swing state and swing position in conjunction with vertical operation of the pressing plates 53*a* to 53*c* guided by the guide slots 67, 68 and guide pins 57, 58. FIG. 5B illustrates a state in which the pressing plates 53*a* to 53*c* wait in a top dead center position, FIG. 10 illustrates a state in which the plates perform press binding on a bunch of sheets (not shown) in a bottom dead center position, and FIG. 11 illustrates a state in which the plates wait in a sheet receiving position below the top dead center position.

Figure 16A:
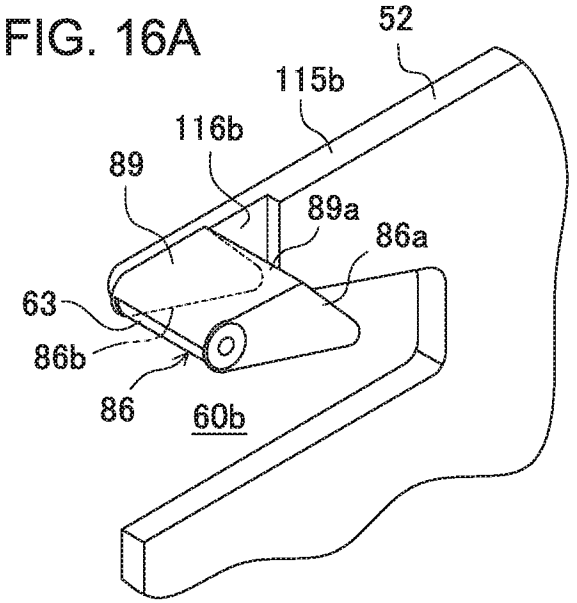
FIG. 16A is a perspective view illustrating an attachment state of a sheet guide.
Figure 16B:
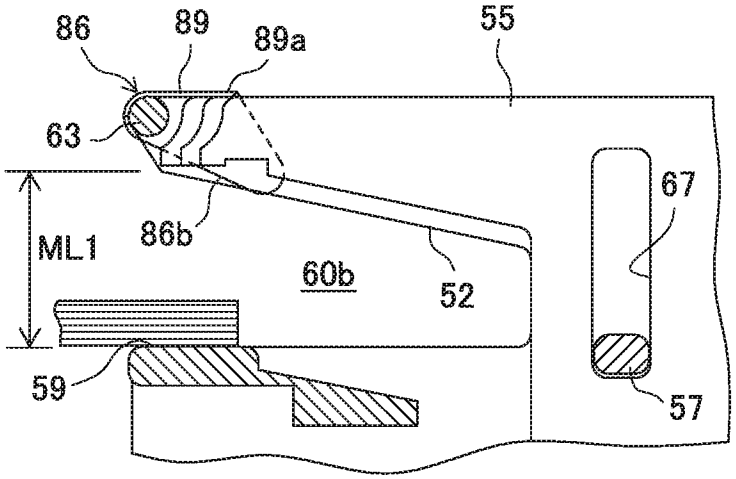
FIGS. 16B to 16D are explanatory views illustrating position relationships between the sheet guide and the pressing plates.
Figure 16C:
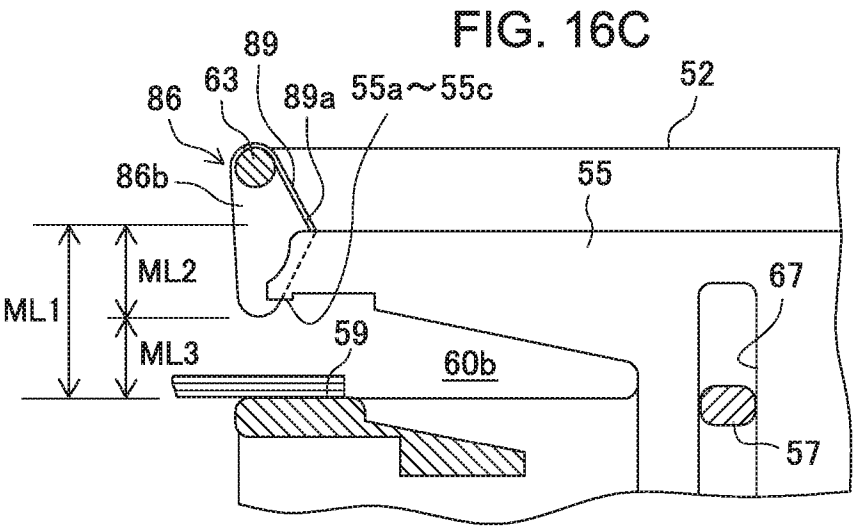
Figure 16D:
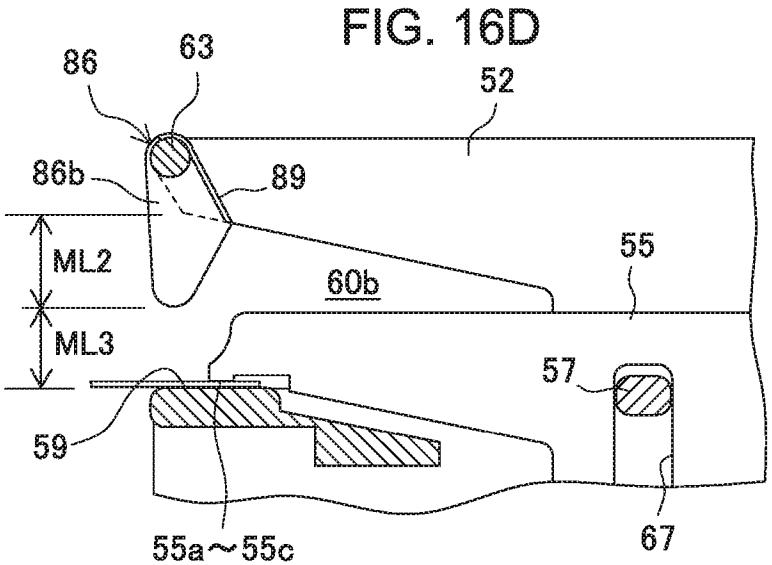

As shown in FIGS. 10 and 16D, in a press bind position where the pressing teeth 55*a* to 55*c* mesh with the receiving tooth 59 in the bottom dead center position of the pressing plates 53*a* to 53*c*, the sheet guide 86 is in the state of naturally hanging swingably, and its low end is positioned in approximately the same height as that of the upper edge of the pressing plates 53*a* to 53*c*.

The number of sheets on which the needle bind unit 81 is capable of performing needle binding at a time is about several tens, and in contrast thereto, the number of sheets on which the press bind unit 82 is capable of performing press binding at a time is about several. Accordingly, as shown in FIGS. 16B to 16D, when it is assumed that the opening height of the notches 60*a*, 60*b* is ML1, the opening height of the notches limited by the sheet guide 86 is ML2, and that the opening height of the notches at this point is ML3, ML3 is set at a dimension that enables the number of sheets undergoing press binding to be carried in the placement portion 31 smoothly. Accordingly, ML2 is set at a size capable of reserving ML3 with respect to ML1.

Figure 11:
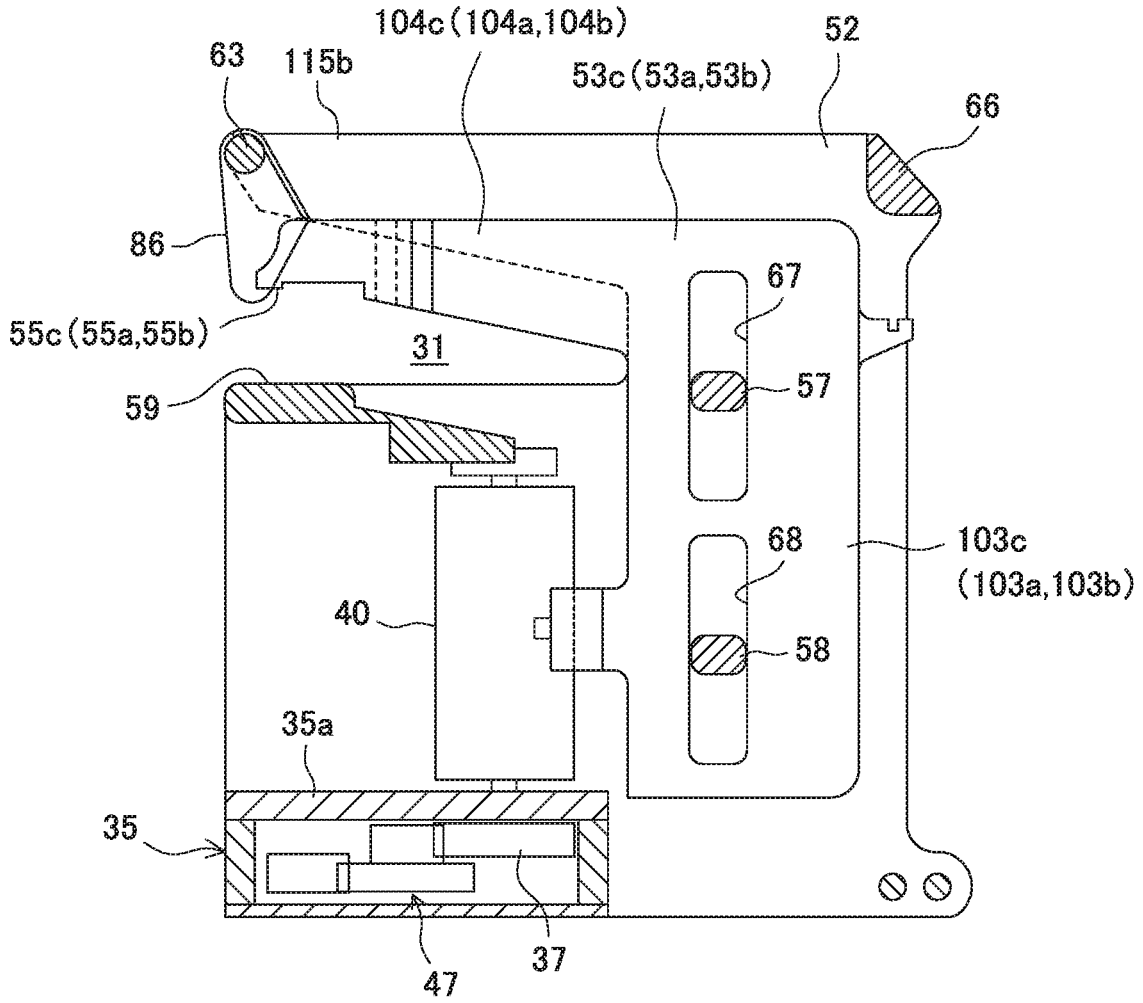
FIG. 11 is an explanatory view of a sheet receiving position in which the pressing tooth separates upward from the receiving tooth.

As shown in FIGS. 11 and 16C, when the pressing plates 53*a* to 53*c* are in the sheet receiving position, the sheet guide 86 is in the state of naturally hanging swingably, and the pressing plates 53*a* to 53 are in a position of not protruding downward from the low end of the sheet guide 86 where front end portions of respective pressing arm portions 104*a* to 104*c*, particularly the pressing teeth 55*a* to 55*c* are stored in between the guide pieces 86*a*, 86*b*. Accordingly, the sheet to undergo press binding is guided smoothly to the placement portion 31, without its front end being caught in the pressing teeth 55*a* to 55*c*.

In this Embodiment, in the sheet receiving position, the pressing plates 53*a* to 53*c* are disposed so that upper edges of front end portions of the pressing arm portions 104*a* to 104*c* contact a rear end 89*a* of the engagement plate portion 89 of the sheet guide 86. Accordingly, when the pressing plates 53*a* to 53*b* shift toward the top dead center position from this position, the sheet guide 86 rotates upward in conjunction with the ascent of the pressing plates.

As shown in FIGS. 5A and 16A, in the front end portions of the fixed arm portions 115*a*, 115*b*, in their inner surfaces are formed shallow concave portions 116*a*, 116*b* that correspond to the guide pieces 86*a*, 86*b* of the sheet guide 86. When the pressing plates 53*a* to 53*c* arrive at the top dead center position, the guide pieces 86*a*, 86*b* of the sheet guide 86 are stored in the concave portions 116*a*, 116*b*.

As shown in FIGS. 5B and 16B, looking from the side surface, the sheet guide 86 overlaps the fixed arm portion 115*b* (115*a*) of the base plate 52 (and front plate 51) to hide, and is held not to protrude to the inside of the notches 60*a*, 60*b* from the lower side of the fixed arm portion. Accordingly, since the opening height of the notches 60*a*, 60*b* is maximum (ML1), as shown in FIG. 16B, in a state in which a bunch of sheets undergoing needle binding is placed in the placement portion 31, it is possible to shift the needleless bind unit 82 smoothly to the rear side or the front side on the shift bench 77 shown in FIG. 3 together with the needle bind unit 81, without the bunch of sheets being caught in inner peripheries of the notches 60*a*, 60*b*.

[Press Drive Mechanism]

As shown in FIG. 5B, the press bind drive portion base 35 is formed in the shape of a rectangular box with a pair of upper and lower plates and a pair of side plates. On the top surface of the upper plate 35*a*, the press bind motor 46 is fixed perpendicularly on the notch opening side with its output shaft protruding inside the press bind drive portion base 35. On the notch back side on the top surface of the upper plate 35*a*, a circular cam 40 is inserted rotatably perpendicularly parallel with the press bind motor 46.

As shown in FIG. 6B, the cylindrical cam 40 has a rotating shaft 49 integrally formed in the same axis. A bearing 43 is mounted on the upper end of the rotating shaft 49, and a spring washer 96 made of a wave washer is interposed between the bearing and the top surface of the circular cam 40. The bearing 43 is fixed to a bearing support portion 18, and supports the upper end side of the cylindrical cam 40 rotatably. The lower portion of the rotating shaft 49 is supported by the upper plate 35*a* rotatably, with its lower end protruding inside the press bind drive portion base 35. At this point, the lower surface of the cylindrical cam 40 directly slides on the top surface of the upper plate 35*a* or is supported via an appropriate bearing.

In the press bind drive portion base 35 is stored a deceleration gear line 47 comprised of a drive gear 46*a* installed in the front end of the output shaft of the press bind motor 46, a driven gear 37 installed in the lower end of the rotating shaft 49 of the cylindrical cam 40, and an intermediate gear 44 that meshes with the gears 46*a* and 37. The rotation force of the press bind motor 46 is decelerated by the deceleration gear line 47, and is transferred to the cylindrical cam 40.

A cam groove 41 is provided in a concave shape in the outer surface of the cylindrical cam 40. The cam groove 41 turns to substantially make two loops in a counterclockwise spiral shape. In the cam groove 41 are engaged the cam follower pints 56*a* to 56*c* of the pressing plates 53*a* to 53*c* successively in the rotation direction of the cylindrical cam 40. Therefore, the follower pin support portions 69*a* to 69*c* are formed so as to displace angle positions of the follower pins 56*a* to 56*c* gradually with respect to the rotating shaft 49.

In this Embodiment, the follower pin support portion 69*b* of the pressing plate 53*b* at the center extends in the same plane as the pressing plate, and the cam follower pin 56*b* is provided to be opposed to, at the front, the outer surface of the cylindrical cam 40 along the line M shown in FIG. 5A.

In contrast thereto, in the pressing plates 53*a*, 53*c* on the front side and rear side, each of the follower pin support portions 69*a*, 69*c* is bent in the shape of a mountain for protruding outward with respect to the center follower pin support portion 69*b* in the out-of-plane direction. By this means, the cam follower pins 56*a*, 56*c* on the front side and rear side are provided to face the rotation center axis of the cylindrical cam 40 respectively along the lines L, M shown in FIG. 5A. By this means, it is possible to reliably engage the cam follower pins 56*a* to 56*c* in the cam groove 41.

Further, three pressing springs 61*a* to 61*c* made of tension springs each having the same tension strength are installed among the pressing plates 53*a* to 53*c*, front plate 51 and base plate 52. By this means, the pressing plates 53*a* to 53*c* are always biased downward in a direction in which the pressing teeth 55*a* to 55*c* apply pressure to the receiving tooth 59.

As shown in FIGS. 5A and 5B, in the center pressing spring 61*b*, its upper end is fastened to the spring fastening portion 62*b* at the upper end of the center pressing plate 53*b*, and its lower end is fastened to the joint pin 64*b*. In the pressing springs 61*a*, 61*c* on the front side and rear side, their upper ends are fastened to the spring fastening portions 62*a*, 62*c* at the upper ends of the pressing plates 53*a*, 53*c* on the front side and rear side, and their lower ends are fastened to the joint pin 64*a*, respectively. As described above, the center spring fastening portion 62*b* and joint pin 64*b* are disposed with their positions slightly displaced to the notch opening side from the other spring fastening portions 62*a*, 62*c* and joint pin 64*a*. By this means, without expanding a gap between the front plate 51 and the base plate 52, it is possible to arrange three pressing springs 61*a* to 61*c* in the narrow gap.

When the press bind motor 46 is rotated to rotate the cylindrical cam 40 in a clockwise direction in the figure, the pressing plates 53*a* to 53*c* are moved down in the direction of pressing sheets on the placement portion 31. At this point, the pressing plates 53*a* to 53*c* are acted upon downward by both the rotation drive force of the press bind motor 46 via the cylindrical cam 40 and the tension force of the pressing springs 61*a* to 61*c*. Thus, by configuring that a part of the pressing force of the pressing teeth 55*a* to 55*c* to the receiving tooth 59 is obtained from the pressing springs 61*a* to 61*c*, it is possible to decrease output of the press bind motor 46 itself to store in the narrow gap between the front plate 51 and the base plate 52, and to actualize miniaturization.

When the cylindrical cam 40 is rotated in a counterclockwise direction in the figure by the press bind motor 46, the pressing plates 53*a* to 53*c* are moved up in a direction of separating from the placement portion 31. At this point, the biasing force of the pressing springs 61*a* to 61*c* acts on the press bind motor 46 as resistance. Accordingly, the press bind motor 46 needs output for at least enabling the pressing plates 53*a* to 53*c* to be moved up smoothly against the biasing force of the pressing springs 61*a* to 61*c*.

[Control Configuration]

Figure 18:
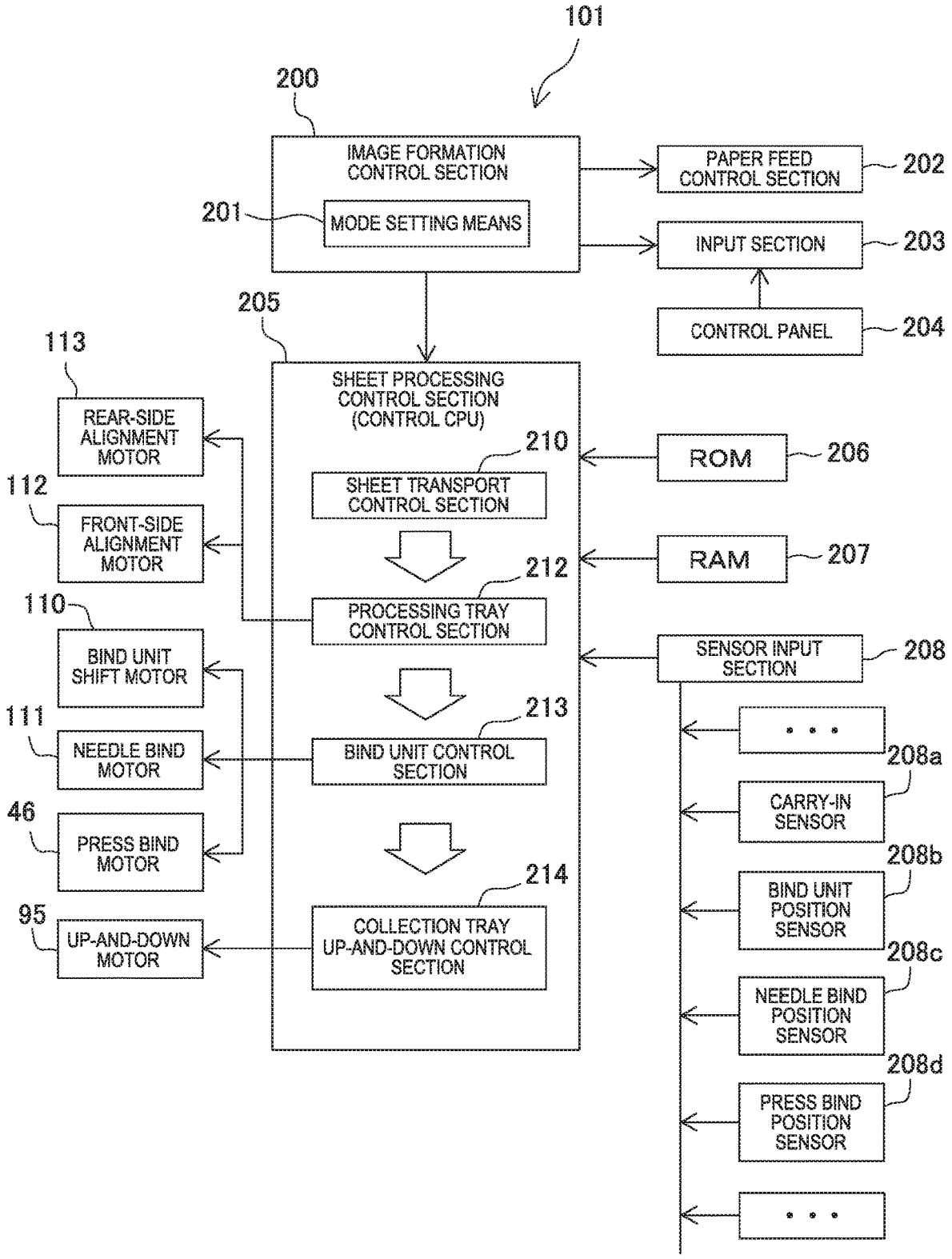
FIG. 18 is a block diagram illustrating a control configuration of an image formation apparatus including the sheet processing apparatus of Embodiment 1.

FIG. 18 illustrates a configuration of a control apparatus 101 of the image formation system according to this Embodiment. The control apparatus 101 is comprised of an image formation control section 200 that controls image formation operation in the image formation apparatus A, and a sheet processing control section 205 that controls post-processing operation in the sheet processing apparatus B.

The image formation control section 200 is provided with a mode setting means 201 to set an image formation made and finish mode. The finish mode includes a binding processing mode for collating and collecting sheets with images formed to perform binding processing, and a print-out mode for storing sheets in the collection tray 90 without performing binding processing, and is set at one of modes by a user of the image formation system.

In the image formation system, an input section 203 having a control panel not shown is disposed on the front side, and a user of the image formation system inputs desired finish mode, sheet size and binding mode to designate from the input section 203. When these setting are performed, the image formation control section 200 transmits the set descriptions to the sheet processing control section 205 with a finish mode instruction signal S1, sheet size signal S2, binding mode instruction signal S3 and the like.

The sheet processing control section 205 controls post-processing operation performed on fed sheets with images formed in the image formation apparatus A. The sheet processing control section 205 is comprised of a CPU, executes control programs stored in ROM 206, thereby actualizes each function of a sheet transport control section 210, processing tray control section 212, bind unit control section 213 and collection tray up-and-down control section 214, and performs post-processing operation. RAM 207 stores data required for execution of the control programs. Then, to the sheet processing control section 205 is input a detection signal from each sensor disposed in each portion of the sheet processing apparatus B via a sensor input section 208.

When a carry-in sensor 208*a* detects that a sheet with an image formed in the image formation apparatus A is fed from the discharge roller 14, the sheet transport control section 210 controls operation of rollers and the like of each transport system in the sheet processing apparatus B, and receives the fed sheet so as to perform predetermined post-processing corresponding to the descriptions shown by the finish mode instruction signal S1, sheet size signal S2, and binding mode instruction signal S3 output from the image formation control section 200.

The processing tray control section 212 controls rotation of alignment motors 112 and 113 respectively on the front side and rear side for shifting the alignment plates 84*a*, 84*b* to perform positioning of the sheet in the transport orthogonal direction, so as to collate and collect sheets transported from the image formation apparatus A on the processing tray 75 in executing the binding processing mode.

Based on the sheet size signal S2 and binding mode instruction signal S3, the bind unit control section 213 controls operation of needle binding or press binding corresponding to a size of fed sheets. At this point, the bind unit control section 213 controls the bind unit shift motor 110 so as to shift and halt the bind unit 81 with a bind unit position sensor 208*b*. In needle binding, based on a detection signal from a needle bind position sensor 208*c*, the section 213 controls drive of the needle bind motor 111 so as to perform needle binding on a bunch of sheets ST in a predetermined needle bind position. In press binding, based on a detection signal from a press bind position sensor 208*d*, the section 213 controls drive of the press bind motor 46 so as to perform press binding on a bunch of sheets ST in a predetermined press bind position.

Based on a detection signal from a sheet height position sensor 208*e*, the collection tray up-and-down control section 214 controls drive of the up-and-down motor 95 so as to hold a height position of sheets collected on the collection tray 90 in a predetermined height position.

[Operation of Press Binding]

In the press bind unit 82, by the cylindrical cam 40 rotating substantially twice, the pressing plates 53*a* to 53*c* move down, and the pressing teeth 55*a*, 55*b*, 55*c* sequentially sandwich a bunch of sheets ST and press the receiving tooth 59 to crimp. Developed views of FIGS. 12A to 13F illustrate a position relationship between a track of the cam follower pins 56*a* to 56*c* that shift along the cam groove 41 for a period during which the cylindrical cam 40 rotates twice, and the receiving tooth 59 of each of the pressing teeth 55*a* to 55*c* corresponding to height positions of the pressing plates 53*a* to 53*c* at this point.

Figure 12A:
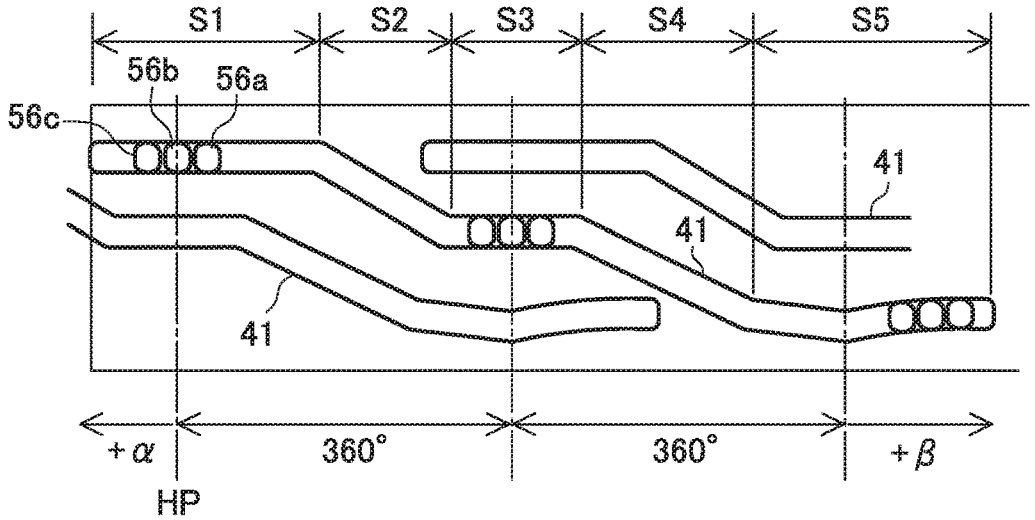
FIG. 12A is a developed view of a cam groove of the cylindrical cam.

As shown in FIG. 12A, along the circumferential direction of the cylindrical cam 40, the cam groove 41 is comprised of a horizontal region S1 in a highest position in the shaft line direction of the cam 40, a region S2 that is inclined substantially a certain angle downward from the region S1, a horizontal region S3 in a position of rotating substantially 360° from the region S1, a region S4 that is inclined substantially a certain angle downward from the region S3, and a last region S5. As described later in relation to FIG. 13A, in the region S5, press operation by the pressing teeth 55*a* to 55*c* is performed.

Figure 12B:
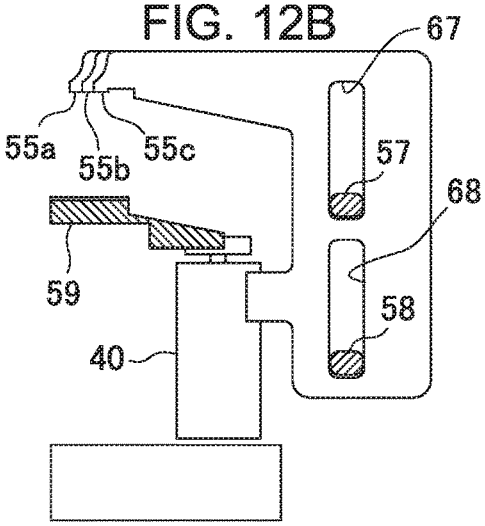
FIGS. 12B to 12E are explanatory views illustrating shifts of the pressing plates in association with rotation of the cylindrical cam.

First, the cam follower pins 56*a* to 56*c* wait in a home position HP in the region S1. FIG. 12B illustrates a state in which each of the pressing plates 53*a* to 53*c* is in the top dead center position. At this point, a slight gap is formed between the guide pins 57, 58 of the base plate 52 and lower ends of the guide slots 67, 68 of each of the pressing plates 53*a* to 53*c*. By this means, when the pressing plates 53*a* to 53*c* arrive at the top dead center position, the guide pins 57, 58 are prevented from colliding with the lower ends of the guide slots 67, 68 to generate a rattle, or being damaged.

In this state, in performing press binding operation of a bunch of sheets ST sequentially fed from the image formation section 2, the bind unit control section 213 of the sheet processing control section 205 controls the bind unit shift motor 110, and shifts the press bind unit 82 to a press bind portion of the bunch of sheets ST. Then, the bind unit control section 213 drives the press bind motor 46 to rotate the cylindrical cam 40 in the clockwise direction in the figure. By this means, the cam follower pins 56*a* to 56*c* shift relatively along the cam groove 41, and for a period during which the pins engage in the cam groove 41 in the region S1, the height position of each of the pressing plates 53*a* to 53*c* is not changed, and is held in the state shown in FIG. 12B.

When the cam follower pins 56*a* to 56*c* shift from the region S1 to the region S2 of the cam groove 41, the positions of the cam follower pins 56*a* to 56*c* are sequentially lowered along inclination of the region S2, and in association therewith, combined with the tension force of the pressing springs 61*a* to 61*c*, each of the pressing plates 53*a* to 53*c* mutually adjoins downward to shift, while sliding. This is a state shown in FIG. 12C.

Figure 12D:
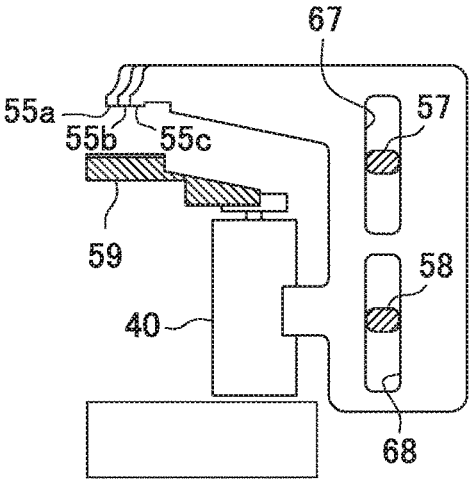
Figure 12C:
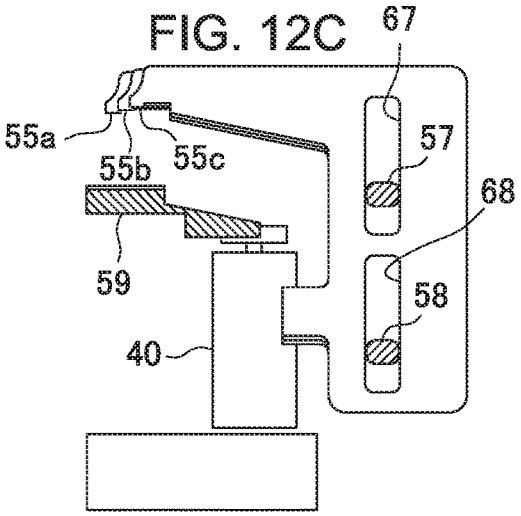

Further, when rotation of the cylindrical cam 40 proceeds and the cam makes an about one rotation from the home position HP, the cam follower pins 56*a* to 56*c* shift from the region S2 to the region S3 of the cam groove 41. Since the region S3 corresponds to the sheet receiving position of FIGS. 11 and 16C, and the cam groove is formed horizontally, as shown in FIG. 12D, the pressing plates 53*a* to 53*c* are aligned in a height position about ⅓ to ½ the distance between the receiving tooth 59 and the plates in an initial state. In this state, the press bind unit 82 waits for that the sheet is transported to the placement portion 31, and the sheet guide 86 sags downward to narrow an entrance opening of the placement portion 31, and guides the fed sheet.

When all sheets undergoing press binding are transported to the placement portion 31, second-loop rotation of the cylindrical cam 40 is started, and crimping is performed by nipping a bunch of sheets ST by the pressing teeth 55*a* to 55*c* and the receiving tooth 59. Accordingly, when press binding is indicated, the press bind unit 82 rotates the cylindrical cam 40 one loop instantaneously, waits for that sheets are transported to the placement portion 31, and when all the sheets are transported, performs crimping by rotation of second-loop rotation, and therefore, it is possible to perform press binding in a short time.

Figure 12E:
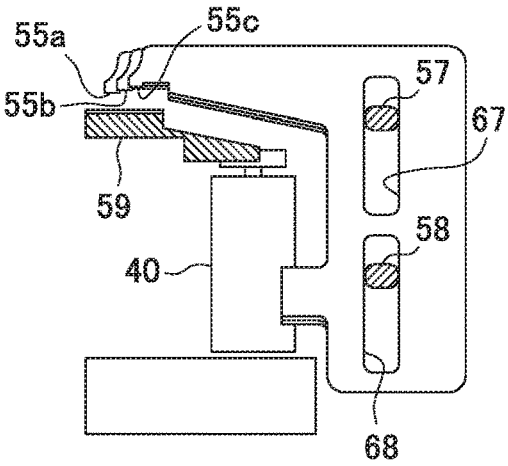

In the second-loop rotation of the cylindrical cam 40, the region where the cam follower pins 56*a* to 56*c* engage in the cam groove 41 is switched from S3 to S4. S4 is a region where the groove is inclined again, and as shown in FIG. 12E, the position of the follower pins 56*a* to 56*c* is lowered.

When the cylindrical cam 40 makes near two rotations from the home position HP, the cam follower pins 56*a* to 56*c* shift from the region S4 to the region S5 of the cam groove 41. The region S5 is a region where the pressing teeth 55*a* to 55*c* nip a bunch of sheets ST and sequentially press the receiving tooth 59, and press binding is thereby formed.

Figure 13A:
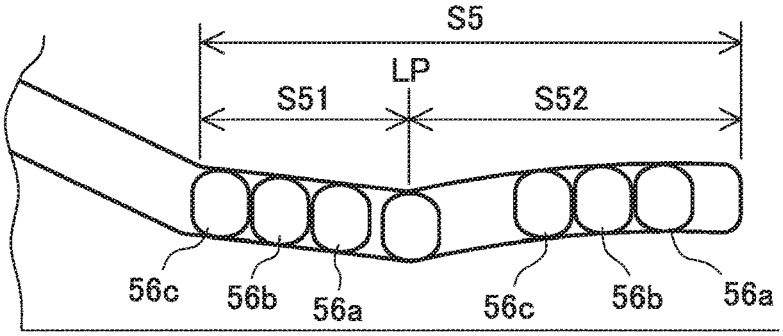
FIG. 13A is a partial developed view illustrating a region S5 of the cam groove of the cylindrical cam.
Figure 13B:
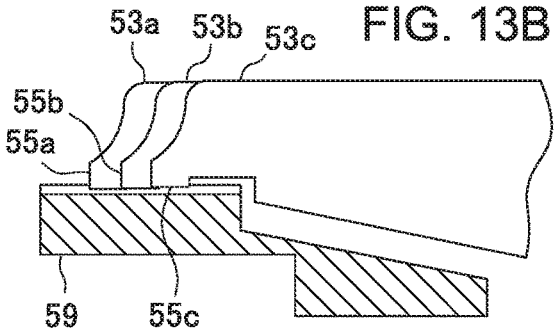
FIGS. 13B to 13F are explanatory views illustrating shifts and pressing operation of the pressing plates in associated with rotation of the cylindrical cam continued from FIG. 12E.

FIGS. 13A to 13F illustrate pressing operation performed by the cam follower pins 56*a* to 56*c* engaging in the region S5 of the cam groove 41. As shown in FIG. 13A, the region S5 of the cam groove 41 is divided into an S51 region continued to the region S4, and an S52 region reaching a lower end portion of the cam groove 41 with the lowest position LP as a boundary. The S51 region is a groove inclined downward moderately, and as shown in FIG. 13B, as the teeth proceed toward the lowest point LP, height positions of the pressing teeth 55*a*, 55*b*, 55*c* are gradually lowered sequentially starting with the pressing tooth 55*a* to mesh with the receiving tooth 59.

Figure 13C:
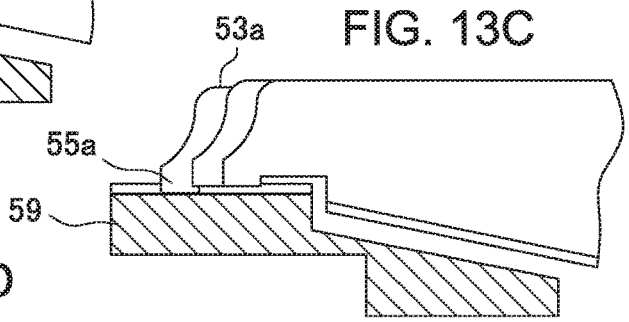
Figure 13D:
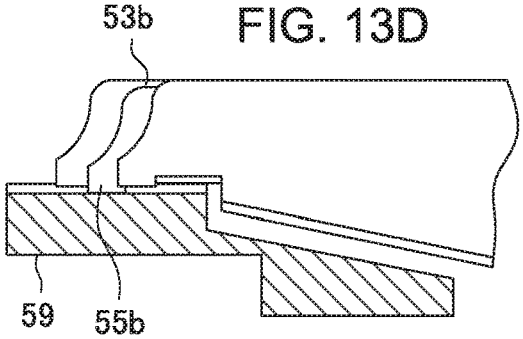
Figure 13E:
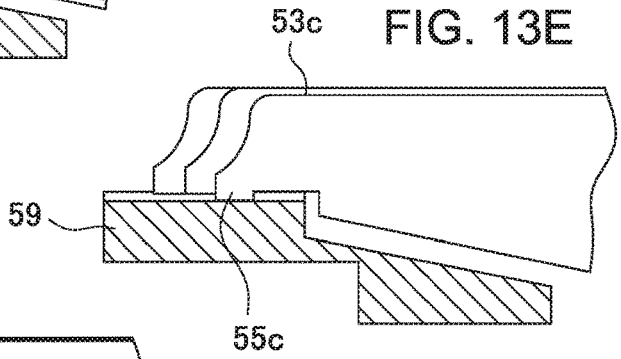

Whenever the cam follower pins 56*a* to 56*c* sequentially pass through the lowest point LP of the cam groove 41 one by one, as shown in FIGS. 13C to 13E, the pressing teeth 55*a* to 55*c* are pressed to the receiving tooth 59 by strong pressure i.e. by pressing force larger than in the region S51 to be driven. As described above, since the teeth are divided into three pressing teeth, the pressing area by one pressing tooth is only ⅓ the entire pressing area. Accordingly, it is possible to crimp a bunch of sheets ST strongly by a pressing load smaller than in the case of pressing the entire pressing area at a time by a single pressing tooth.

At this point, as shown in FIGS. 10 and 16D, each of the pressing plates 53*a* to 53*c* is in the bottom dead center position, and a slight gap is formed between the guide pins 57, 58 of the base plate 52 and upper ends of the guide slots 67, 68 of each of the pressing plates 53*a* to 53*c*. By this means, when the pressing plates 53*a* to 53*c* arrive at the bottom dead center position, the guide pins 57, 58 are prevented from colliding with the upper ends of the guide slots 67, 68 to generate a rattle, or being damaged At this point, the pressing teeth 55*a* to 55*c* are provided with the tension force of respective pressing springs 61*a* to 61*c* as the pressing force to the receiving tooth 59. As described above, since the pressing load necessary for each of the pressing teeth 55*a* to 55*c* is only low, the weak spring force is enough for each of the pressing springs 61*a* to 61*c*, and it is possible to also decrease the dimensions thereof. Accordingly, it is possible to miniaturize the entire apparatus. Further, since the guide pins 57, 58 are provided to be spaced a certain clearance away from the upper ends of the guide slots 67, 68 of each of the pressing plates 53*a* to 53*c* also after pressing, pressing is reliably performed.

When the pressing teeth 55*a* to 55*c* come into contact with the receiving tooth 59 with a bunch of sheets ST therebetween, there is the risk that the cam groove 41 and the follower pins 56*a* to 56*c* are locked by a thrust load generated in the shaft direction of the cylindrical cam 40 by a thickness of the bunch of sheets ST. In this Embodiment, as shown in FIG. 6B, the thrust load is received evenly in the circumference direction by the spring washer 96 provided between the bearing 43 and the cylindrical cam 40, and the lock between the cam groove and the cam follower pins is thereby prevented from occurring.

Figure 13F:
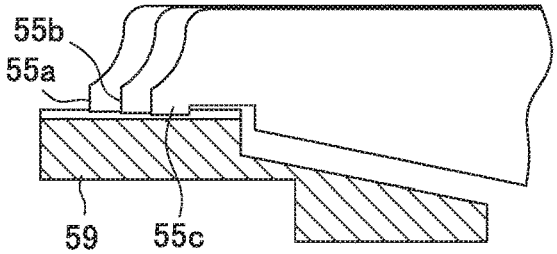

When the cam follower pins 56*a* to 56*c* pass through the lowest point LP, since the S52 region of the cam groove 41 is a groove inclined upward, meshing of the pressing teeth 55*a* to 55*c* with the receiving tooth 59 is gradually shallower starting with the pressing tooth 55*a*, and is in a state shown in FIG. 13F. At this point, as shown in FIG. 10, in each of the pressing plates 53*a* to 53*c*, since the guide pins 57, 58 are fitted into two guide slots 67, 68 provided vertically, respectively, the pressing plates 53*a* to 53*c* do not rotate by the tension force of the pressing springs 61*a* to 61*c*, and are moved upward reliably by rotation of the cylindrical cam 40. In addition, as shown in FIG. 10, when the pressing plates 53*a* to 53*c* release contact with the sheet guide 86, the sheet guide 86 narrows an opening on the entrance side of the placement portion 31 of a bunch of sheets ST, and guides introduction of a subsequent sheet.

When the cylindrical cam 40 makes about two rotations in the clockwise direction, and sequential pressing to the receiving tooth 59 by the pressing teeth 55*a* to 55*c* is finished, the bind unit control section 213 next rotates the press bind motor 46 backward, and performs control to return the pressing plates 53*a* to 53*c* to the home position HP. Accordingly, when the cylindrical cam 40 rotates in the counterclockwise direction in the figure, and the cam follower pins 56*a* to 56*c* shift from the region S52 to the region S51 of the cam groove 41, the pins sequentially pass through the lowest point LP again. At this point, starting with the pressing tooth 55*c* this time, the pressing tooth 55*b* and pressing tooth 55*a* sequentially pass through the strong pressure position in the lowest point LP, and second pressing to the receiving tooth 59 is performed by the tension force of the pressing springs 61*c* to 61*a*.

Then, the cylindrical cam 40 makes about two rotations in the counterclockwise direction, and the cam follower pins 56*a* to 56*c* follow the cam groove 41 inversely, and return to the home position HP. In association therewith, the slide guides 57, 58 of the base plate 52 shift relatively from the upper end to the lower end of long holes 67, 68 respectively, and therefore, the pressing plates 53*a* to 53*c* shift perpendicularly by the tension force of the pressing springs 61*a* to 61*c*. Accordingly, the cam mechanism by engagement of the cam groove 41 of the cylindrical cam 40 and the cam follower pins 56*a* to 56*c* controls the tension force of the pressing springs 61*a* to 61, and only in pressing, enables the tension force to be used in crimping a bunch of sheets ST.

[Press Binding Operation]

Figure 14:
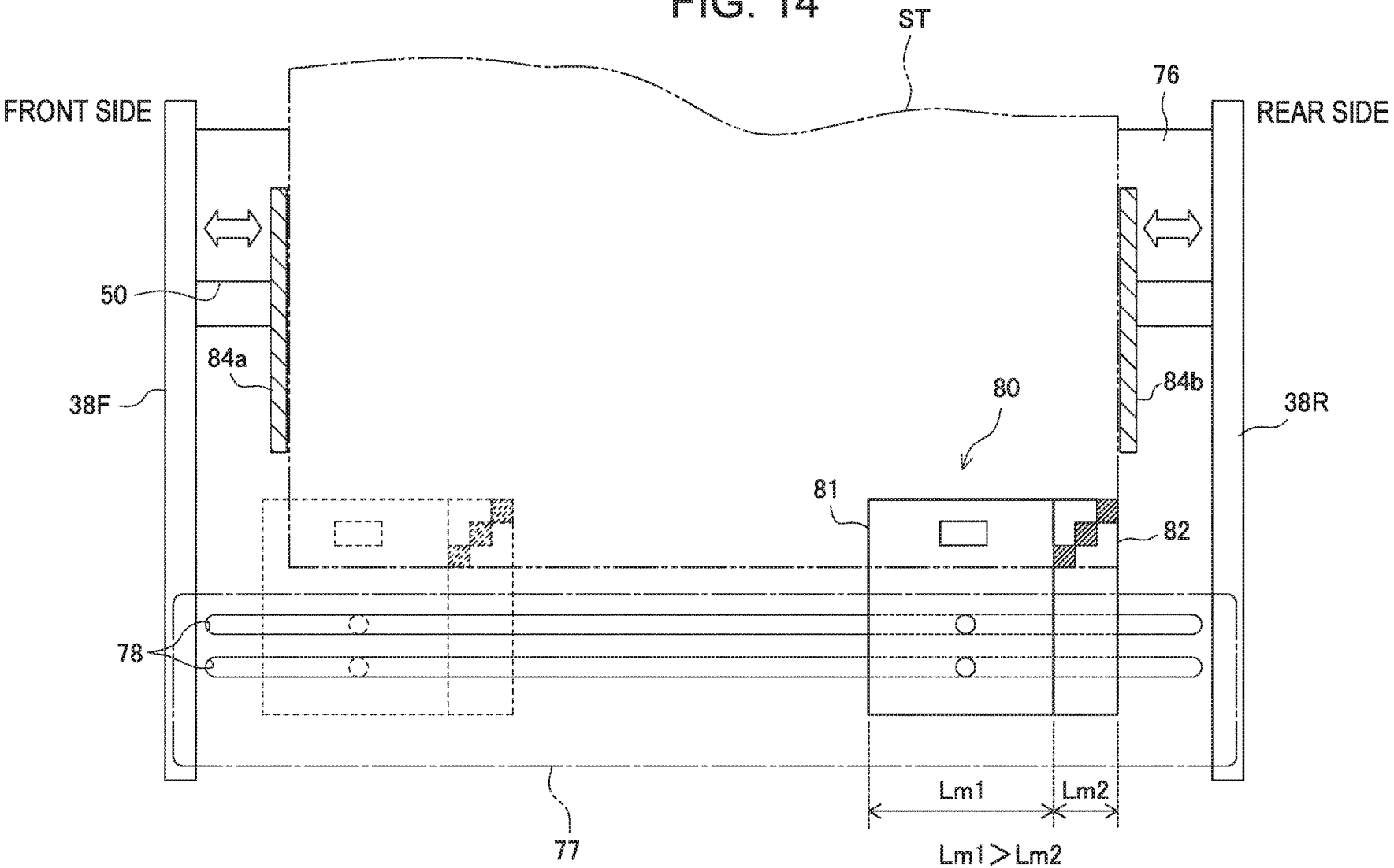
FIG. 14 is an explanatory view illustrating a position of the press bind unit in the case of performing press binding on sheets.

FIG. 14 illustrates a position of the sheet bind apparatus 80 along the shift bench 77, in the case of performing press binding on a bunch of sheets on the processing tray 76 with the press bind unit 82. In FIG. 14, a bunch of sheets ST is placed with its center position in the right-and-left direction aligned in the center position of the processing tray 76. At this point, the sheet bind apparatus 80 beforehand waits in a position slightly before a most outward position on the rear side on the processing tray 76.

In this state, a sheet is transported onto the processing tray 76, the alignment plates 84*a*, 84*b* on both left and right sides are driven to align in the center position of the processing tray 76, and this operation is repeated to form a bunch of sheets. At this point of time, in the bunch of sheets thus formed on the processing tray 76, the side portion is placed inside the placement portion 31 of the press bind unit 82 and the opening portion of the needle bind unit 81. By this means, a corner portion on the rear side of the bunch of sheets ST is positioned in the placement portion 31 of the press bind unit 82, and it is possible to press-bind the corner portion.

Further, in the press bind unit 82, in a waiting state of FIG. 14, the pressing plates 53*a* to 53*c* shift to the sheet receiving position. By this means, it is possible to shorten a vertical shift distance of the pressing plates required for press binding, and to suppress the processing time.

In another Embodiment, in the position of a bunch of sheets in FIG. 14, by shifting the sheet bind apparatus 80 to the front side, it is possible to perform press binding on a different position in the side portion of the bunch of sheets ST. Further, by changing the position in the right-and-left direction of the bunch of sheets ST by the alignment plates 84*a*, 84*b*, while fixing the position of the sheet bind apparatus 80, it is possible to similarly change a bind position of the bunch of sheets by press binding.

[Needle Binding Operation]

Figure 15:
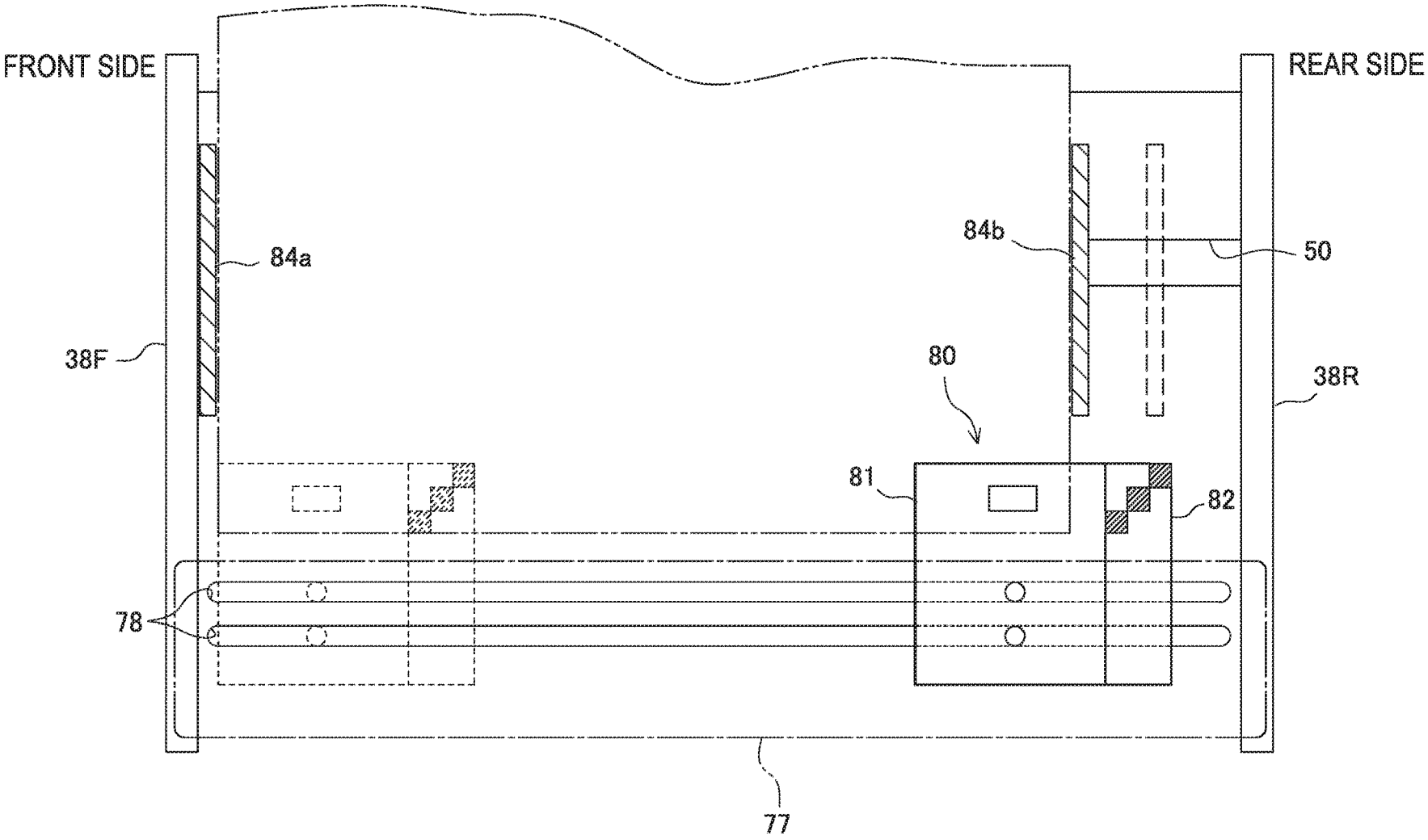
FIG. 15 is an explanatory view illustrating a position of the needle bind unit in the case of performing needle binding on a bunch of shifted sheets on the rear side.

FIG. 15 illustrates a position of the sheet bind apparatus 80 along the shift bench 77, in the case of performing needle binding on the corner portion on the rear side of a bunch of sheets on the processing tray 76 with the needle bind unit 81. In FIG. 15, the sheet bind apparatus 80 is disposed in the most outward position on the rear side on the shift bench 77. In the needle bind unit 81 in this Embodiment, the press bind unit 82 is provided together on the rear side, and therefore, the needle bind position is shifted to the front side, as compared with the case of the needle bind unit alone.

Therefore, in this Embodiment, a bunch of sheets, which is collated on the processing tray 76 by the alignment plates 84*a*, 84*b* on both left and right sides, is shifted to the front side again by the alignment plates, and its corner portion on the rear side is disposed in a bind position of the needle bind unit 81 i.e. table 87. At this point, in the press bind unit 82, the pressing plates 53*a* to 53*c* are in the top dead center position shown in FIGS. 5B and 16B, and the sheet guide 86 is also stored in the fixed arm portions of the front plate 51 and base plate 52. Accordingly, the placement portion 31 is expanded at the maximum in the vertical direction, and space opened between the pressing teeth 55*a* to 55*c* and the receiving tooth 59 is maximum in the vertical direction. As a result, it is possible to shift a bunch of sheets disposed on the table 87 of the needle bind unit 81 smoothly, without the sheets being caught in the pressing teeth 55*a* to 55*c* and/or other portion of the press bind unit 82.

Particularly, also in the case of performing needle binding in a plurality of positions of a bunch of sheets of which the number is high, as shown in FIGS. 5B and 16B, as in the opening portion of the needle bind unit 81, the press bind unit 82 of this Embodiment is capable of expanding the placement portion 31 largely in the vertical direction. Accordingly, a smooth shift of the needle bind unit 81 is secured.

[Modifications of the Cam Groove of the Cylindrical Cam]

Figure 17A:
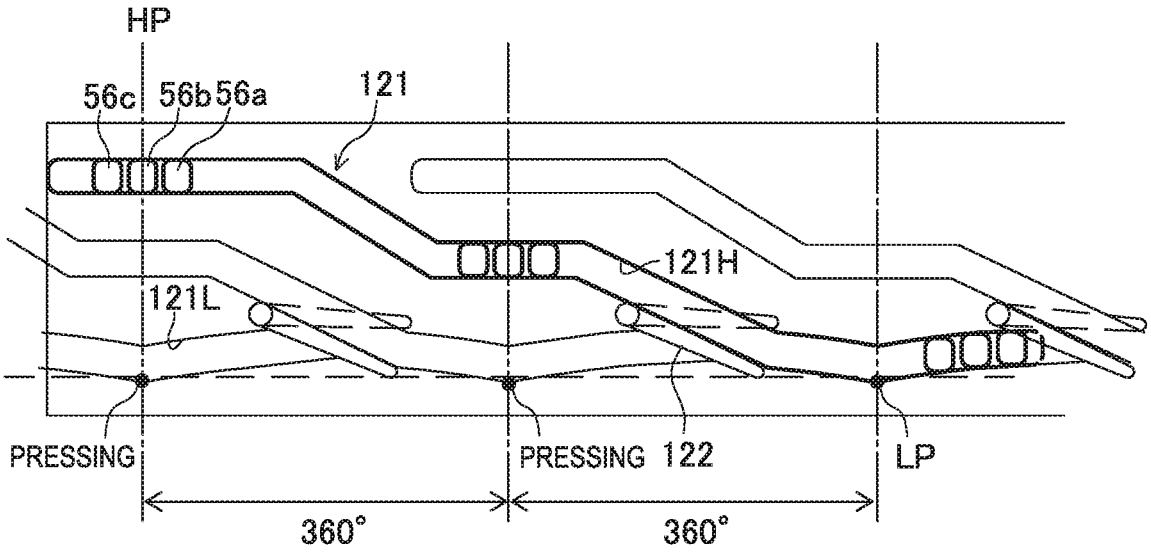
FIGS. 17A and 17B are developed views respectively illustrating Modifications of the cam groove.

FIG. 17A illustrates a Modification of the cam groove 41 formed in the cylindrical cam 40. A cam groove 121 is the same as the cam groove 41 until arrival at the lowest position LP, and subsequent thereto, a groove portion 121L is continuously provided in the shape of snaking vertically in same height positions of the cam circumference. In this case, in a portion where the groove portion 121L snaking by rotation of the cylindrical cam 40 crosses an upper groove portion 121H reaching the groove portion 121L, a gate 122 that opens/closes in one direction is provided to enable the cam follower pins 56*a*, 56*b*, 56*c* to shift only in the direction along rotation of the cylindrical cam 40.

When the cylindrical cam 40 provided with such a cam groove 121 is rotated, as in the case of the cam groove 41, the cam follower pins 56*a*, 56*b*, 56*c* positioned in the home position HP follow the cam groove 121 and shift downward in the cylindrical cam 40. However, when the cam follower pins 56*a*, 56*b*, 56*c* arrive at the groove portion 121L, the pins snake along the shape of the groove portion 121L and shift in the horizontal direction. Accordingly, whenever the cam follower pins 55*a*, 56*b*, 56*c* pass through a valley portion of snaking, the pressing plates 55*a*, 55*b*, 55*c* sequentially press the receiving tooth 59 a plurality of times by the tension force of the pressing springs 61*a*, 61*b*, 61*c*.

Then, when the cam follower pins 55*a*, 56*b*, 56*c* follow the groove portion 121L and arrive at the gate 122, the pins push the gate 122 aside, and return to the beginning of the groove portion 121L again. Subsequently, for a period during which rotation of the cylindrical cam 40 is continued, the cam follower pins 55*a*, 56*b*, 56*c* continue to travel in the groove portion 121L, and whenever arriving at the valley portion of snaking, the pressing teeth 55*a*, 55*b*, 55*c* perform pressing. Accordingly, the groove portion 121L is set in the shape of pressing a bunch of sheets ST a plurality of times, by the pressing teeth 55*a*, 55*b*, 55*c* repeating the shift between the position separated upward from the receiving tooth 59 and the press position. By this means, the bunch of sheets ST is subjected to press binding firmly.

Next, when the cylindrical cam 40 is rotated backward, the cam follower pins 55*a*, 56*b*, 56*c* follow the groove portion 121L in the opposite direction, are introduced to the groove portion 121H by the gate 122 when arriving at the beginning of the groove portion 121L, follow the cam groove 121 inversely, and return to the home position HP. In addition, when the cylindrical cam 40 is rotated backward, for a period during which the cam follower pins 55*a*, 56*b*, 56*c* shift in the groove portion 121L of the cam groove 121, whenever the pins pass through the valley portion of snaking, the pressing plates 55*a*, 55*b*, 55*c* press the receiving tooth 59.

Figure 17B:
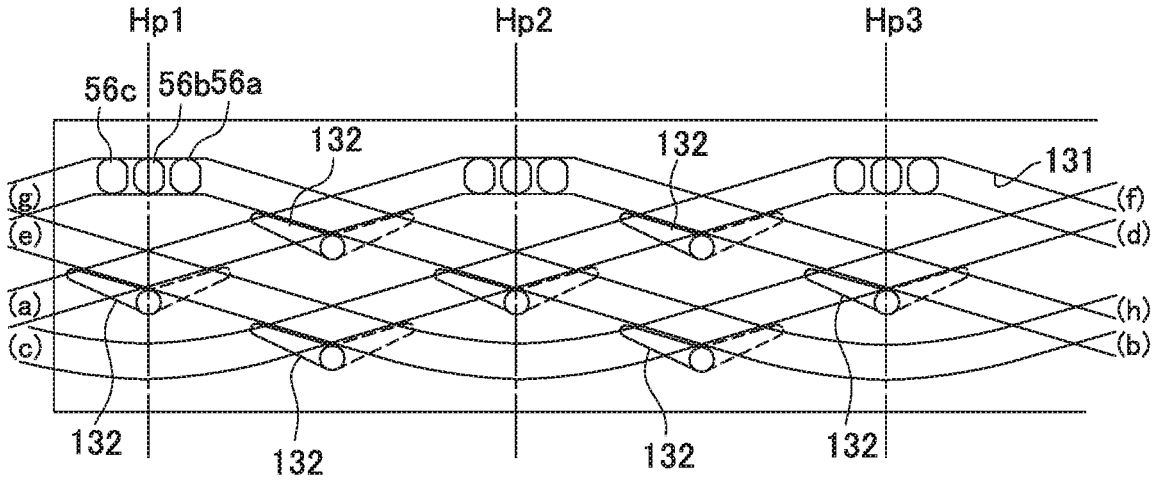

FIG. 17B illustrates an Embodiment where in the circumference surface of the cylindrical cam 40 is formed a cam groove 131 in the shape of a spiral repeated endlessly from above to below and from below to above. The cam groove 131 in this case is connected in a closed loop as shown by (a)-(b)-(c)-(d)-(e)-(f)-(g)-(h)-(a) in FIG. 17B. In the endless cam groove 131, even when the cylindrical cam 40 rotates forward and backward and causes a difference in the rotation direction, tracks followed by cam follower pins 55*a*, 56*b*, 56*c* are the same. Accordingly, in the cam groove 131, a gate 132 for switching between two directions corresponding to the direction along rotation is provided in each portion where the grooves cross.

According to the cam groove 131 in such a shape, even in the case where rotation of the press bind motor 46 is one direction (for example, clockwise rotation), when the cam follower pins 55*a*, 56*b*, 56*c* are positioned in a mountain portion in the highest position of the cylindrical cam 40, the pressing plates 53*a*, 53*b*, 53*c* are in the home position HP, and when the pins are positioned in a valley portion in the highest position of the cylindrical cam 40, sequential pressing to the receiving tooth 59 by the pressing teeth 55*a*, 55*b*, 55*c* is performed by descent of the pressing plates 53*a*, 53*b*, 53*c*. In this case, when the gate 132 is closed, the cam follower pins 55*a*, 56*b*, 56*c* following the cam groove 131 push the gate aside to switch. Accordingly, by rotation in one direction of the press bind motor 46, the pressing teeth 55*a*, 55*b*, 55*c* shift between the press position and the position separated upward from the receiving tooth 59, and crimp the bunch of sheets ST repeatedly. As a matter of course, when the gate is disposed as shown by dotted lines shown in the figure, the same operation is performed also by backward rotation (i.e. counterclockwise rotation) of the press bind motor 46.

[Modification of the Drive System]

In the sheet bind apparatus 80, by sharing a single drive motor as drive sources of the needle bind unit 81 and press bind unit 82, it is possible to more reduce the size and weight. In a sheet processing apparatus in Embodiment 2 of the present invention, it is configured that the needle bind motor 111 of the needle bind unit 81 is capable of being selectively connected to the press bind unit 82.

[Clutch Mechanism]

Figure 19:
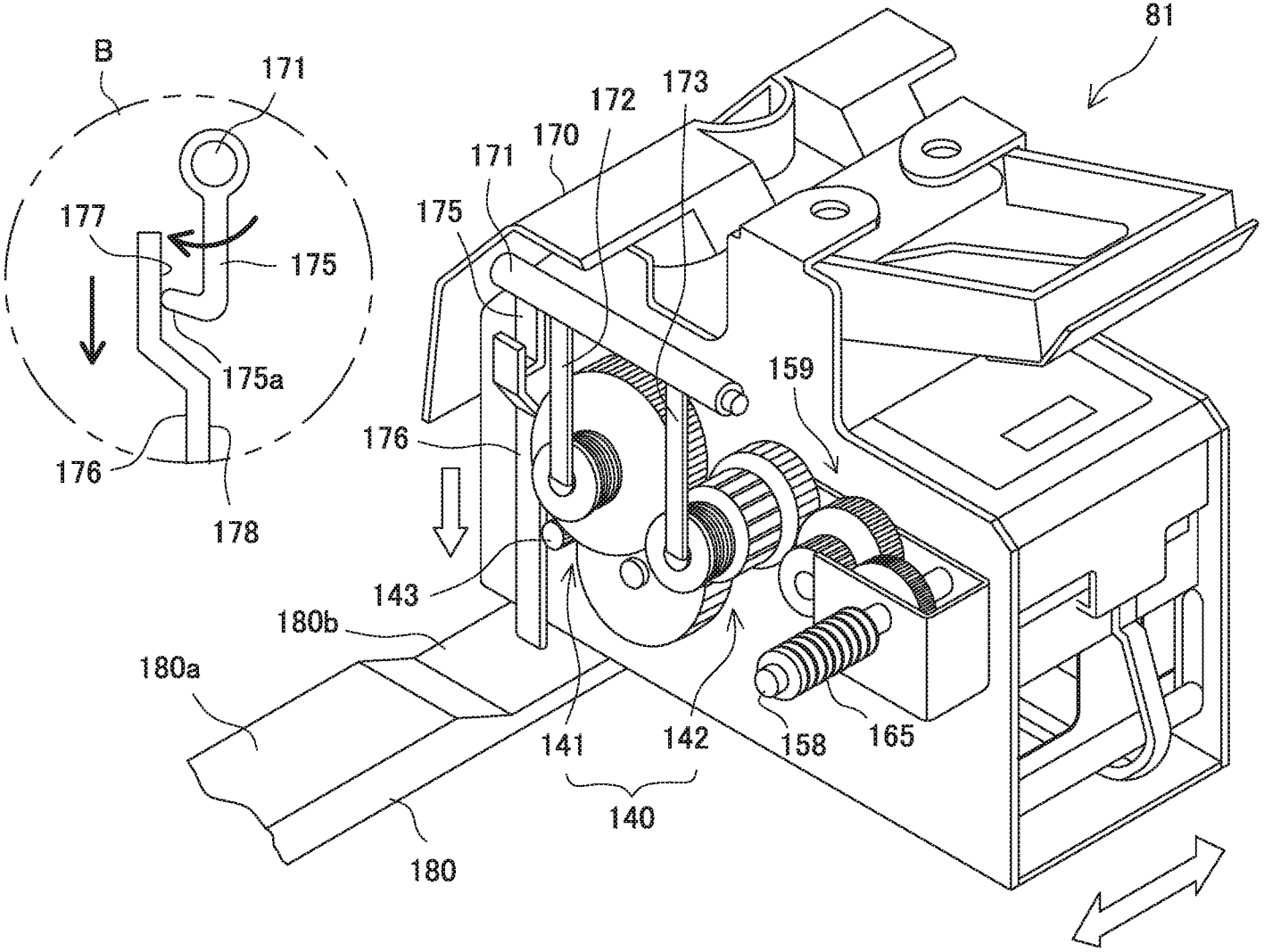
FIG. 19 is a perspective view of a clutch mechanism in a state in which a common drive motor is connected to the needle bind unit in a sheet processing apparatus of Embodiment 2.
Figure 20:
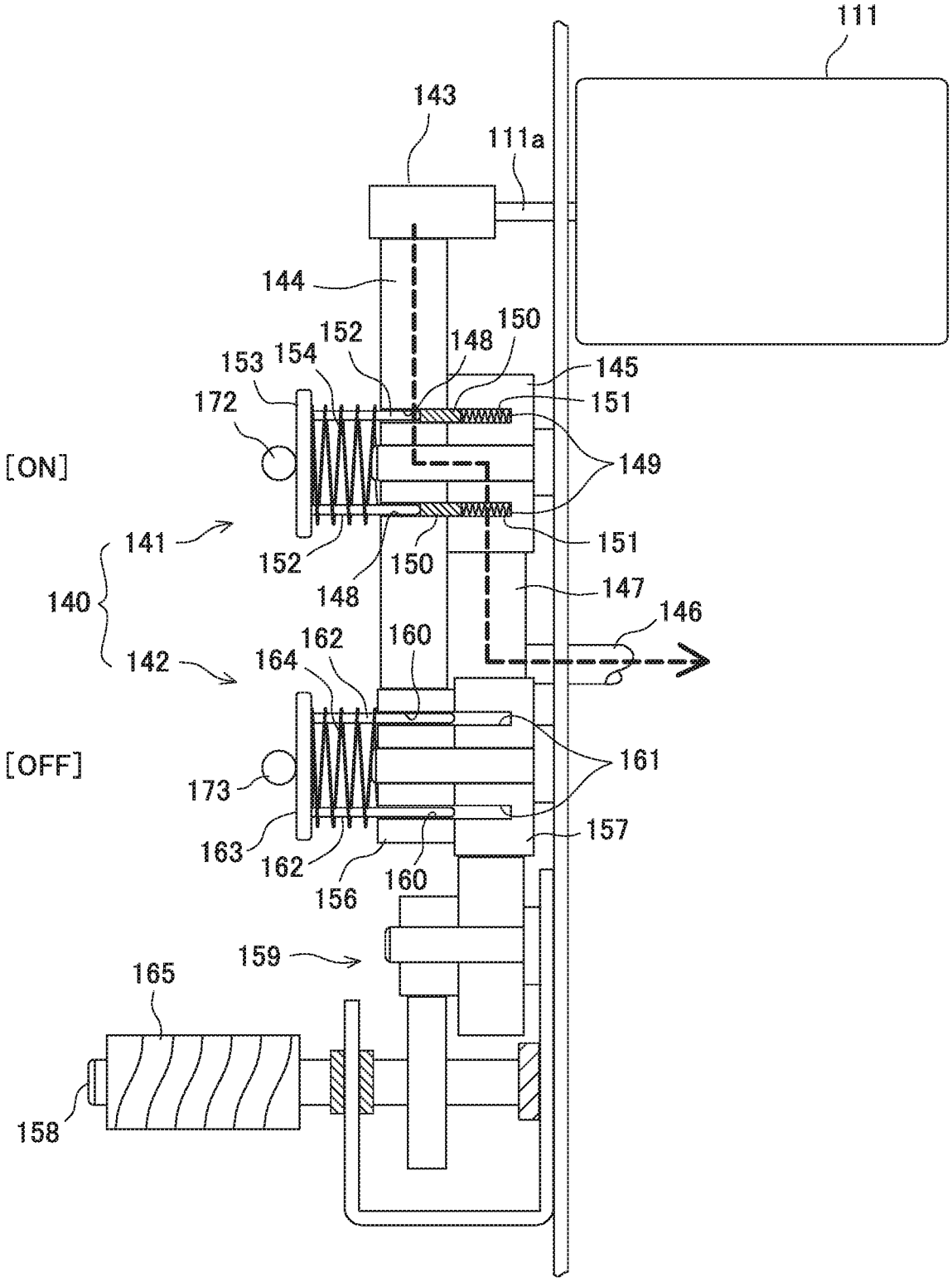
FIG. 20 is a partial sectional view, looking the clutch mechanism of FIG. 19 from above.

FIGS. 19 and 20 illustrate a clutch mechanism 140 to connect the needle bind motor 111 of the needle bind unit 81 to the press bind unit 82. The clutch mechanism 140 is provided with a first clutch portion 141 to connect an output shaft 111*a* of the needle bind motor 111 to the drive cam 85 of the needle bind unit 81, and a second clutch portion 142 to connect to the cylindrical cam 40 of the press bind unit 82.

[First Clutch Portion]

The first clutch portion 141 is provided with a first transmission gear 144 that always meshes with a drive gear 143 installed in the output shaft 111*a* of the needle bind motor 111, and a second transmission gear 145 disposed in the side surface on the needle bind unit 81 side of the first transmission gear slidably about the same shaft. The second transmission gear 145 always meshes with a driven gear 147 installed in a rotating shaft 146 of the drive cam 85.

In the first transmission gear 144 and second transmission gear 145, a plurality of pairs of pin holes 148, 149 with the same diameter is formed in opposite slide surfaces of the gears in corresponding positions on the concentric circles with the same radiuses as those of the rotating center shafts of the gears, respectively. In each of pairs of pin holes 148, 149, a single engagement pin 150 is installed to be able to shift smoothly between both the pin holes with positions mutually aligned.

The pin hole 149 of the second transmission gear 145 is a hole with a bottom, and in the bottom portion is disposed a compression spring 151 between the engagement pin 150 and the bottom, and the spring always biases the engagement pin 150 to the first transmission gear 144 side. The pin hole 148 of the first transmission gear 144 is a through hole, and a first shift pin 152 is inserted from an opening on the side opposite to the second transmission gear 145 detachably in the direction of pushing the engagement pint 150 to the second transmission gear 145 side.

The first shift pin 152 of each pin hole 148 is integrally coupled to a common first push member 153 outside the first transmission gear 144. A compression spring 154 is interposed between the first push member 153 and the first transmission gear 144, and always biases the first push member outward in a direction of separating from the first transmission gear 144.

[Second Clutch Portion]

The second clutch portion 142 is provided with a third transmission gear 156 that always meshes with the first transmission gear 144, and a fourth transmission gear 157 disposed in the side surface on the needle bind unit 81 side of the second transmission gear slidably about the same shaft. The fourth transmission gear 157 always meshes with an intermediate gear line 159 connected between the gear and an output shaft 158 that transfers the rotation drive force of the needle bind motor 111 to the cylindrical cam 40 of the press bind unit 82.

In the third transmission gear 156 and fourth transmission gear 157, a plurality of pairs of pin holes 160, 161 with the same diameter is formed in opposite slide surfaces of the gears in corresponding positions on the concentric circles with the same radiuses as those of the rotating center shafts of the gears, respectively. The pin hole 161 of the fourth transmission gear 157 is a hole with a bottom. The pin hole 160 of the third transmission gear 156 is a through hole, and a second shift pin 162 is inserted from an opening on the side opposite to the fourth transmission gear 157 detachably toward the fourth transmission gear 157 side.

The second shift pin 162 of each pin hole 160 is integrally coupled to a common second push member 163 outside the third transmission gear 156. A compression spring 164 is interposed between the second push member 163 and the third transmission gear 156, and always biases the second push member outward in a direction of separating from the third transmission gear 156.

Figure 23B:
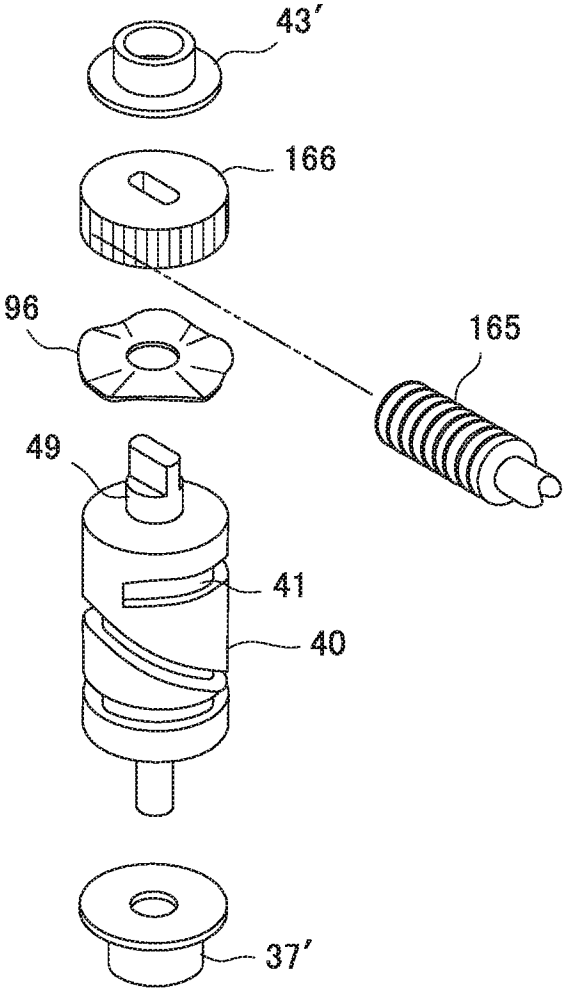
FIG. 23B is an exploded perspective view illustrating a cylindrical cam and components related thereto.
Figure 23A:
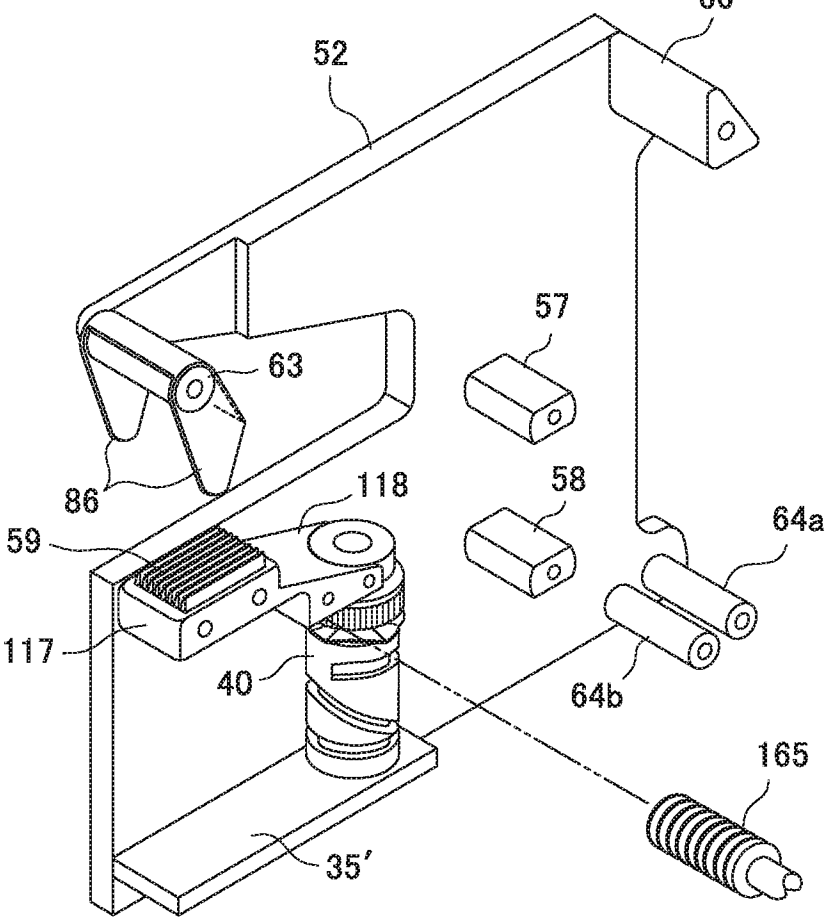
FIG. 23A is a perspective view illustrating a drive system of the press bind unit of Embodiment 2.

In the output shaft 158 of the press bind unit 82, a worm 165 is installed at its front end. Corresponding thereto, as shown in FIGS. 23A and 23B, in the press bind unit 82, a worm wheel 166 that always meshes with the worm 165 is installed to integrally rotate with the rotating shaft 49 of the cylindrical cam 40. The worm wheel 166 is interposed between the spring washer 96 and a bearing 43' fixedly supported by the bearing support portion 118 of the base plate 52. The lower surface of the cylindrical cam 40 is supported slidably by a support bench 35' fixed to the base plate 52 via a bearing 37'.

[Clutch Switch Mechanism]

The clutch mechanism 140 has a clutch switch rod 171 installed rotatably in an apparatus frame 170 of the needle bind unit 81. As shown in FIG. 19, the clutch switch rod 171 extends in a direction orthogonal to the output shaft 111*a* of the needle bind motor 111, above the first push member 153 and second push member 163. The clutch switch rod 171 is integrally provided with first and second switch arms 172, 173 extending downward orthogonal to the rod 171. Front end portions of the first and second switch arms 172, 173 come into contact with outer surfaces of the first and second push members 153, 163, and regulate positions in the shaft line direction of the pin holes 148, 160 of the first and second push members 153, 163 biased outward by the compression springs 154, 164, respectively.

[Needle Bind Drive]

When the clutch switch rod 171 is in a first rotation position shown in FIGS. 19 and 20, the first switch arm 172 pushes the first push member 153 to the first transmission gear 144 side, so that each first shift pin 152 of the first clutch portions 141 pushes the engagement pin 150 into a position astride the pin holes 148, 149 of each pair. At this point, the second switch arm 173 regulates the position of the second push member 163 so that the second shift pin 162 of the second clutch portion 142 is held inside the pin hole 160 of the third transmission gear 156.

By this means, the first transmission gear 144 and second transmission gear 145 of the first clutch portion 141 are coupled to be able to transfer the drive force. On the other hand, in the second clutch portion 142, the third transmission gear 156 and fourth transmission gear 157 are separated. Accordingly, the rotation drive force of the needle bind motor 111 is transferred to the drive cam 85 of the needle bind unit 81, and the needle binding processing is performed.

[Press Bind Drive]

Figure 21:
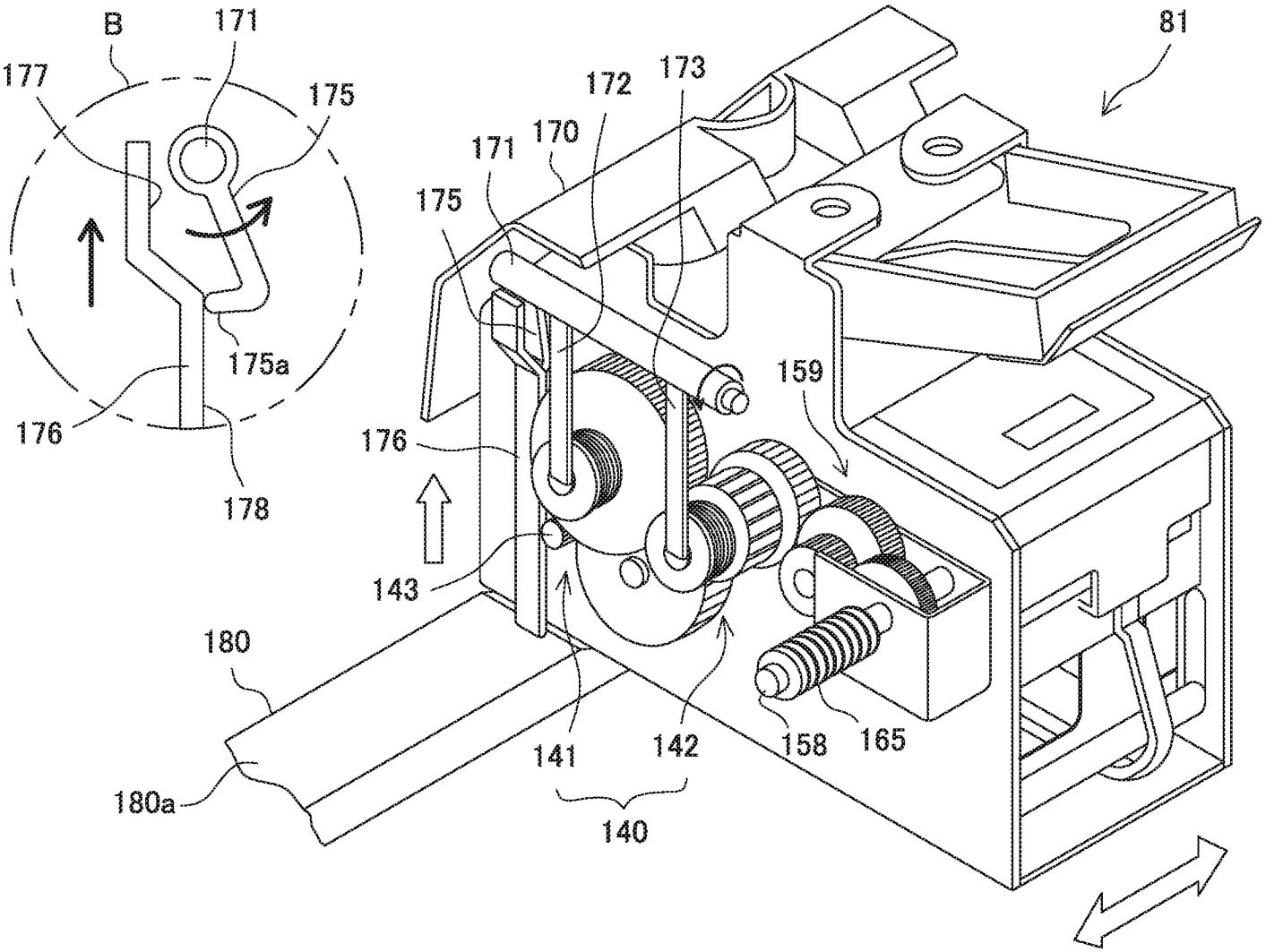
FIG. 21 is a perspective view of the clutch mechanism in a state in which the common drive motor is connected to the press bind unit.
Figure 22:
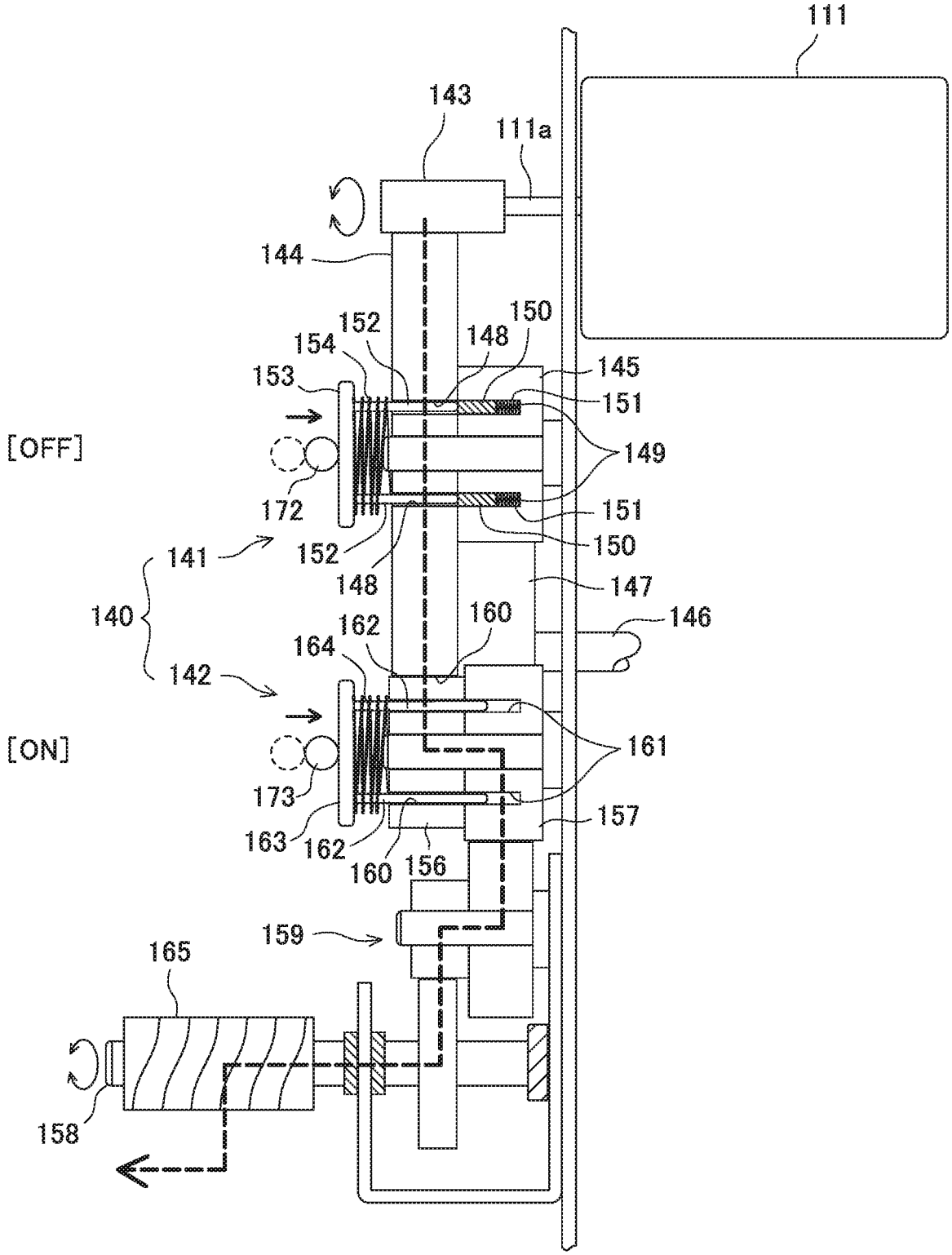
FIG. 22 is a partial sectional view, looking the clutch mechanism of FIG. 21 from above.

When the clutch switch rod 171 is in a second rotation position shown in FIGS. 21 and 22, the first switch arm 172 pushes the first push member 153 to the first transmission gear 144 side, so that each first shift pin 152 of the first clutch portion 141 pushes the engagement pin 150 into a position where the pin completely shifts from the pin hole 148 to the pin hole 149. In contrast thereto, the second switch arm 173 pushes the second push member 163 to the fourth transmission gear 157 side, so that the second shift pin 162 of the second clutch portion 142 protrudes into the pin hole 161 from the pin hole 160 of the third transmission gear 156.

By this means, coupling between the first transmission gear 144 and the second transmission gear 145 of the first clutch portion 141 is released. On the other hand, in the second clutch portion 142, the third transmission gear 156 and fourth transmission gear 157 are coupled to be able to transfer the drive force. Accordingly, the rotation drive force of the needle bind motor 111 is transferred to the output shaft 158 of the press bind unit 82, and the cylindrical cam 40 rotates to perform the press binding processing.

As shown in FIGS. 19 and 21, the clutch switch rod 171 is provided with a drive arm 175 extending downward to integrally rotate, so as to rotate the rod between the first rotation position and the second rotation position. To the apparatus frame 170 of the needle bind unit 81 is attached a substantially linear interlocking bar 176 extending in the vertical direction to be able to shift only in the vertical direction, so as to nip the drive arm 175 between the needle bind unit 81 and the bar at its upper end portion.

As shown in an enlarged view inside alternate long and two short dashed line circle B of each of FIGS. 19 and 21, the upper end portion of the interlocking bar 176 is bent in a direction of separating from a front end 175*a* of the drive arm 175, and the rod is provided with a first surface 177 far from the needle bind unit 81, and a second surface 178 close to the needle bind unit 81 via a height difference below the surface 177. The front end 175*a* of the drive arm 175 is disposed to always comes into contact with the first surface 177, second surface 178 or the height difference of the interlocking bar 176, by that the first and second switch arms 172, 173 are always biased outward by the compression springs 154, 164 via the first and second push member 153, 163, respectively.

As shown inside the alternate long and two short dashed line circle B of FIG. 19, when the interlocking bar 176 moves down, the drive arm 175 rotates in the clockwise direction in the figure in a direction of separating from the needle bind unit 81. As shown inside the alternate long and two short dashed line circle B of FIG. 21, when the interlocking bar 176 moves up, the drive arm 175 rotates in the counterclockwise direction in the figure in a direction of approaching the needle bind unit 81.

Below the needle bind unit 81 is provided a rail member 180 extending along the shift direction of the sheet bind apparatus 80. In a top surface of the rail member 180 is formed an upper surface portion 108*a* and lower surface portion 180*b* slightly lower than the surface 180*a*, via a height difference, along an extension direction of the rail member. The interlocking bar 176 is disposed so that its lower end always contacts the top surface of the rail member 180 by a biasing member such as, for example, a spring (not shown).

Accordingly, when the needle bind unit 81 and rail member 180 shift relatively in the shift direction of the sheet bind apparatus 80, the interlocking bar 176 moves up and down corresponding to a position of contact with the rail member 180. In this Embodiment, in performing the needle binding processing with the needle bind unit 81, the needle bind unit 81 or rail member 180 is shifted, so that the lower end of the interlocking bar 176 comes into contact with the lower surface portion 180*b* of the rail member 180. Conversely, in performing the press binding processing with the press bind unit 82, the needle bind unit 81 or rail member 180 is shifted, so that the lower end of the interlocking bar 176 comes into contact with the upper surface portion 180*a* of the rail member 180.

In this Embodiment, when the press bind unit 82 is in a position on the rear side shown by the solid line in FIG. 14, the press binding processing is performed, and when the unit 82 is in positions except the position, the needle binding processing with the needle bind unit 81 is performed. Accordingly, by beforehand arranging the rail member 180 along the shift bench 77, corresponding to a shift position of the sheet bind apparatus 80, it is possible to automatically switch connection of the clutch mechanism 140 between the press binding processing and the needle binding processing.

Figure 24:
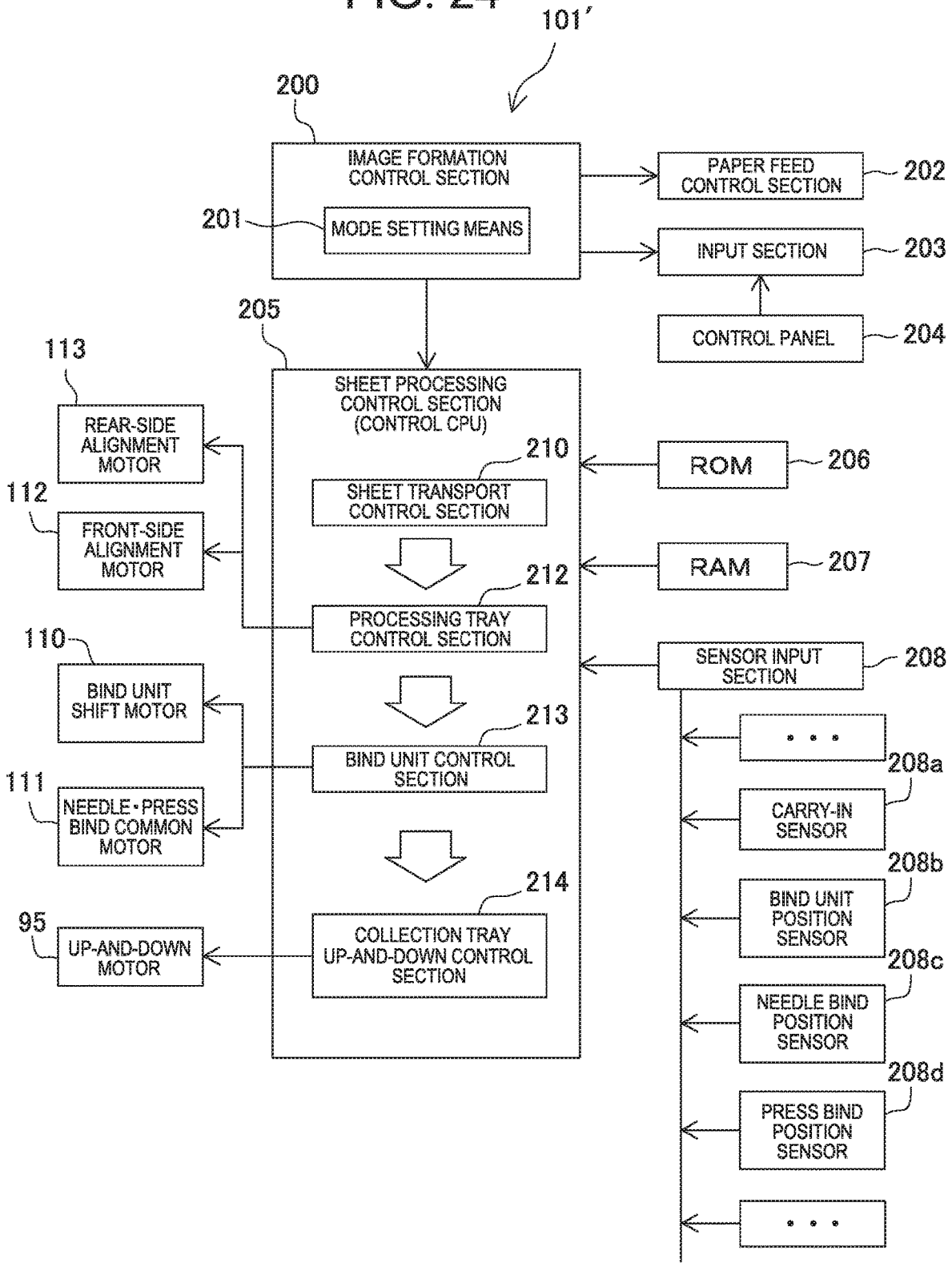
FIG. 24 is a block diagram illustrating a control configuration of an image formation apparatus including the sheet processing apparatus of Embodiment 2.

FIG. 24 illustrates a configuration of a control apparatus 101' of an image formation system to which the above-mentioned Embodiment 2 is applied. As the control apparatus 101 of FIG. 18, the control apparatus 101' is comprised of the image formation control section 200 that controls image formation operation in the image formation apparatus A, and the sheet processing control section 205 that controls post-processing operation in the sheet processing apparatus B. In the control apparatus 101', the bind unit control section 213 controls the bind unit shift motor 110 to shift the sheet bind apparatus 80 on the shift bench 77, and controls operation of the needle bind motor 111 so as to perform the needle binding processing with the needle bind unit 81 or the press binding processing with the press bind unit 82 corresponding to a position of the sheet bind apparatus 80 set by the shift.

In a Modification of the above-mentioned Embodiment 2, as a substitute for the mechanical type clutch mechanism 140 as described above, it is possible to use an electromagnetic clutch. In this case, provided are a first electromagnetic clutch 141' as a substitute for the first clutch portion 141 to transfer the output shaft of the needle bind motor 111 to the drive cam 85 of the needle bind unit 81, and a second electromagnetic clutch 142', as a substitute for the second clutch portion 142, to connect to the cylindrical cam 40 of the press bind unit 82.

Figure 25:
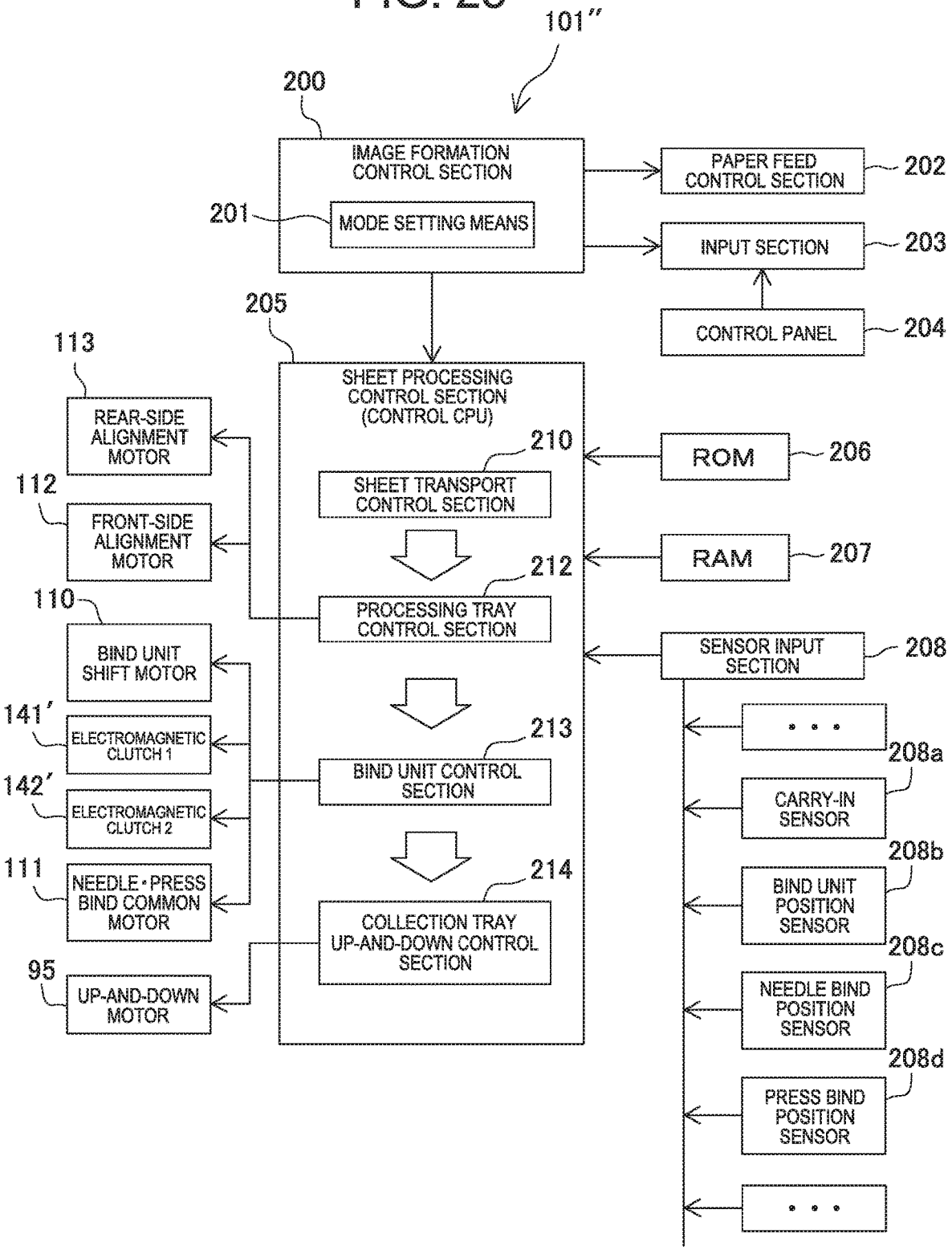
FIG. 25 is a block diagram illustrating a control configuration of an image formation apparatus including a sheet processing apparatus of Modification of Embodiment 2.

FIG. 25 illustrates a configuration of a control apparatus 101" of an image formation system to which the Modification of the above-mentioned Embodiment 2 is applied. As each of above-mentioned control apparatuses 101, 101', the control apparatus 101" is comprised of the image formation control section 200 that controls image formation operation in the image formation apparatus A, and the sheet processing control section 205 that controls post-processing operation in the sheet processing apparatus B. In the control apparatus 101", in addition to controlling operation of the needle bind motor 111 of the needle bind unit 81 that is a common motor of the press bind unit 82, the bind unit control section 213 controls operation of the first electromagnetic clutch 141' and second electromagnetic clutch 142'.

The present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2016-118491 filed on Jun. 15, 2016 in Japan, and Japanese Patent Application No. 2016-118493 filed on Jun. 15, 2016, incorporated herein by reference.

What is claimed is:

1. A sheet processing apparatus comprising:

a transport unit adapted to transport a sheet to a predetermined transport direction;

a placement tray adapted to collate each of a plurality of sheets transported by the transport unit and make a bunch of sheets;

a bind unit adapted to be able to shift to a shift direction along an end edge of the bunch of sheets on the placement tray and bind the bunch of sheets, wherein in the bind unit, a needle bind unit for performing binding processing on the bunch of sheets with a needle and a needleless bind unit for performing binding processing without a needle are provided together in the shift direction of the bind unit, a bunch moving unit adapted to move the bunch of sheets on the placement tray in parallel with the shift direction; and a control unit adapted to control the bind unit and the bunch moving unit to differentiate a position of the needle bind unit and a position of the bunch of sheets in the shift direction when the needle bind unit performs binding processing from a position of the needle bind unit and a position of the bunch of sheets in the shift direction when the needleless bind unit performs binding processing.

2. The sheet processing apparatus according to claim 1, wherein a length of the needleless bind unit is shorter than a length of the needle bind unit in the shift direction of the bind unit.

3. The sheet processing apparatus according to claim 2, wherein each of the needleless bind unit and the needle bind unit has an individual drive motor to perform the binding processing, and the drive motor of the needleless bind unit and the drive motor of the needle bind unit are selectively driven.

4. The sheet processing apparatus according to claim 3, wherein the needleless bind unit is comprised of a plurality of plate members disposed along the shift direction of the bind unit, a pressing tooth provided in each of the plate members, and a receiving tooth provided on the backside side of the sheets to undergo binding processing, and each of the plate members is provided to be able to shift, so that each pressing tooth sequentially meshes with the receiving tooth to perform binding processing on the sheets without a needle.

5. The sheet processing apparatus according to claim 4, wherein the drive motor of the needleless bind unit is disposed to overlap the receiving tooth in a shift direction of the plate members.

6. The sheet processing apparatus according to claim 5, wherein the pressing tooth of each of the plate members and the receiving tooth are disposed so that a press trace of the sheets by meshing between the pressing tooth and the receiving tooth is formed obliquely with respect to the shift direction of the bind unit.

7. The sheet processing apparatus according to claim 1, wherein the bind unit is provided with a common drive motor to selectively perform binding processing with the needle bind unit and binding processing with the needleless bind unit.

8. The sheet processing apparatus according to claim 7, further comprising:

a clutch mechanism adapted to switch between the binding processing of the needle bind unit and the binding processing of the needleless bind unit by the common drive motor corresponding to reaching a predetermined shift position of the bind unit when the bind unit shifts to the shift direction.

9. The sheet processing apparatus according to claim 8, wherein when the bind unit is in an end portion position in the shift direction along the end edge of the sheets, the clutch mechanism operates to switch a driving force of the common drive motor to the binding processing of the needleless bind unit.

10. The sheet processing apparatus according to claim 9, wherein the clutch mechanism is comprised of an electromagnetic clutch.

11. The sheet processing apparatus according to claim 10, wherein the needleless bind unit is comprised of a plurality of plate members disposed along the shift direction of the bind unit, a pressing tooth provided in each of the plate members, and a receiving tooth provided on the backside side of the sheets to undergo binding processing, and each of the plate members is provided to be able to shift, so that each pressing tooth sequentially meshes with the receiving tooth to perform the binding processing on the sheets without a needle.

12. The sheet processing apparatus according to claim 7, further comprising:

a first clutch adapted to transfer the drive force of the common drive motor to the needle bind unit;

a second clutch adapted to transfer the drive force to the needleless bind unit; and a switch member provided along the shift direction of the bind unit, wherein the switch member connects the first clutch or the second clutch corresponding a shift position of the bind unit.

13. The sheet processing apparatus according to claim 12, wherein a height of the switch member changes along the shift direction, and corresponding to the height of the switch member, the first clutch or the second clutch is connected.

14. The sheet processing apparatus according to claim 13, wherein the needleless bind unit is comprised of a plurality of plate members disposed along the shift direction of the bind unit, a pressing tooth provided in each of the plate members, and a receiving tooth provided on the backside side of the sheets to undergo binding processing, and each of the plate members is provided to be able to shift, so that each pressing tooth sequentially meshes with the receiving tooth to perform the binding processing on the sheets on the placement tray without a needle.

15. The sheet processing apparatus according to claim 1, wherein the needleless bind unit includes a pressing tooth, and a receiving tooth which is disposed to face the pressing tooth with the bunch of sheets interposed therebetween, and perform binding processing on an end part of the bunch of sheets away from the end edge of the bunch of sheets by pressing the end part of the bunch of sheets with the pressing tooth.

16. The sheet processing apparatus according to claim 1, wherein the control unit shifts the bind unit to the shift direction and moves the bunch of sheets on the placement tray to an opposite direction to the shift direction by the bunch moving unit.

17. The sheet processing apparatus according to claim 1, further comprising: an alignment member to align each of a plurality of sheets transported by the transport unit in the shift direction, wherein the bunch moving unit functions dually as the alignment member.

18. An image formation apparatus comprising:

an image formation section adapted to perform image formation on a sheet; and the sheet processing apparatus according to claim 1 adapted to perform binding processing on sheets transported from the image formation section.

* * * * *